US006568845B1

(12) United States Patent
Harada

(10) Patent No.: US 6,568,845 B1
(45) Date of Patent: May 27, 2003

(54) MIXING ELEMENT BODY FOR STATIONARY TYPE MIXER

(75) Inventor: Yasuharu Harada, Aichi (JP)

(73) Assignee: Matrix Global Technology Ltd., Tokyo (JP)

( * ) Notice: Subject to any disclaimer, the term of this patent is extended or adjusted under 35 U.S.C. 154(b) by 0 days.

(21) Appl. No.: 09/830,387

(22) PCT Filed: Sep. 7, 1999

(86) PCT No.: PCT/JP99/04851

§ 371 (c)(1),
(2), (4) Date: Apr. 26, 2001

(87) PCT Pub. No.: WO00/24502

PCT Pub. Date: Apr. 5, 2000

(30) Foreign Application Priority Data

Oct. 26, 1998 (JP) ..... 10-343548

(51) Int. Cl.[7] ..... B01F 5/06
(52) U.S. Cl. ..... 366/340
(58) Field of Search ..... 366/181.5, 336, 366/337, 340; 48/189.4; 138/40, 42

(56) References Cited

U.S. PATENT DOCUMENTS 3,526,391 A * 9/1970 Church, Jr.
3,856,270 A * 12/1974 Hemker
4,614,440 A * 9/1986 King

FOREIGN PATENT DOCUMENTS

| | | | |
|---|---|---|---|
| JP | 58-133824 | * | 8/1983 |
| JP | 60-55173 | * | 12/1985 |
| JP | 4-158003 | * | 6/1992 |
| JP | 9-52034 | * | 2/1997 |
| JP | 9-173807 | * | 7/1997 |
| JP | 10-216493 | * | 8/1998 |
| JP | 10-216495 | * | 8/1998 |

* cited by examiner

*Primary Examiner*—Charles E. Cooley
(74) *Attorney, Agent, or Firm*—Browdy and Neimark, P.L.L.C.

(57) ABSTRACT

A stationary mixing machine for mixing various fluid materials in a line. In a fluid path, a pair of mixing element portions 2 and 3 is concentrically arranged. At a surface formed by overlapping these mixing element portions 2 and 3, a respective fluid path is formed as mixing chambers 8 (13) at the both elements. These mixing chambers are peripherally, radially and concentrically, arranged. Fluid material flown from an opening 5 provided at a central portion of one of the mixing element portions 2 and 3 is flown in a radius direction, the juxtaposed mixing chambers in the adjacent rows can be communicated each other and a shearing stress is applied by providing a partition or a step so as to accomplish uniformly mixed and finely-dividing dispersing action.

10 Claims, 18 Drawing Sheets

MIXING ELEMENT BODY FOR STATIONARY TYPE MIXER

The present application is the national stage under 35 U.S.C. §371 of international application PCT/JP99/04851, filed Sep. 7, 1999, which designated the United States, and which application was not published in the English language.

FIELD OF THE INVENTION

The present invention relates to a mixing element body of a stationary-type mixing machine.

BACKGROUND OF THE INVENTION

In a conventional art, as shown in FIG. 21 to FIG. 24, a stationary type mixing machine for mixing plural fluid materials in a line comprises plural mixing element portions B installed in a cylinder type casing A in order to form a fluid path. The mixing element portion B comprises two discs, a large disc C and a small disc D.

On the large disc C, there is a group cambers G, which consists of small hexagonal chambers F (a shape of a chamber may be a square, an octagonal, a triangle or a round) surrounded a peripheral portion of a fluid hole E. Along a radial direction toward a peripheral edge, a group G of small chambers having a larger diameter surrounded a chamber F of the group G of the small chambers having a small diameter which is described previously, wherein the chambers F have the same shape and the shape size. Thus, a honeycomb (closest packed) arrangement is formed.

The disc D having a small diameter is overlapped on the disc C having a large diameter. On the disc D having a small diameter, hexagonal cylinder chambers F having the same shape and the same size are also arranged in a honeycomb style. The chambers F on the small disc D and the chambers F on the large disc C are confronted each other so as to communicate each chamber F on the small disc D with a corresponding chamber F on the large disc C. That is, a junction portion P of sidewall H forming one chamber F is located at a center of the other chamber F.

In plural the mixing element portions B in the casing A, a backside of the disc C and a backside of the disc Dare confronted each other. An outer peripheral portion of the large disc C and an inner peripheral portion of the casing A are sealed. A fluid path M is formed at a space between an outer peripheral portion of the small disc D and an inner peripheral portion of the casing A.

The fluid path E communicates with the other fluid path E, an inlet J and an outlet K.

In a mixing mechanism, when fluid material is flown to the casing A through the inlet J, the fluid material is flown into an inside of the large disc C of the mixing element body B at an upper stream side through the flow path E of the large disc C. Then, the fluid material is radially flown toward from a center of the disc C to an outer periphery portion through the chambers F communicated each other. The fluid material reached to an inner peripheral portion of the casing A is flown into each chamber F from an outer portion of the mixing element B at a downstream side through the flow path M. After passing through the chambers F communicated each other, the fluid material flows toward a center portion from the outer portion centripetally. Then, the fluid material is again flown from the flow path E to the mixing element B at the downstream side. The fluid material is flown out from the outlet K through the inside of the plurality of the mixing element portions B in order while the fluid material is passed through each chamber F.

However, regardless a shape of a chamber F (hexagonal, square, octagonal, triangle and round) of a conventional stationary mixing machine, there are the following drawbacks.

Chambers F having the same shape and the same size are positioned in a honeycomb arrangement. The more a number of chambers becomes, the more a position of the chambers is moved toward an outer periphery portion. So in the case that the fluid material is flown from the flow path E of the mixing element portion B at the upstream side, the fluid material is dispersed. On the other hand, in the mixing element portion B at the downstream side, the number of the chambers F is decreasing toward a center portion of the element B. That is, the fluid material flown in the plural chambers F are gathered to one chamber F so that the dispersion of the particles can not be expected since the dispersed particles are concentrated in one chamber.

A dispersing condition in which fluid material is flown from a chamber F to the other chamber F confronting to the chamber F is not uniform. Regardless of a flowing direction (outward radial direction or inward radial direction), even if a shape of the chamber F is a hexagonal cylinder as shown in the drawings, there are a case in which the fluid material in the chamber F is divided and flown to two confronted chambers F and another case in which the fluid material in the chamber F is flown to one confronted chamber F. The both cases are existed in the same group G of the chambers. Since chambers F of the group Gare arranged along a radial direction and a number of the arranged chambers F is increasing in order toward an outer peripheral portion, dispersed (divided) room number at an outer region (along a radial direction) of the mixing element portion B and that at a center region (along a radial direction) becomes different. Thereby, the dispersion and mixing are not uniform.

In order to increase a total number of dispersed cases in which fluid material is flown into a chamber in the mixing element portion Band flown out to chambers in the mixing element B (herein after the total number is referred as "total dispersion number"), there is no way except providing a group including chambers having a larger diameter, since the chambers F are arranged closest. Thus, a mixing element B becomes big in a size.

DISCLOSURE OF THE INVENTION

Upon reviewing a phenomenon in which particles are gathered, uneven dispersion and uneven mixing and another phenomenon in which a size of a mixing element portion becomes larger by increasing the total dispersion number in a conventional art, the inventors provide a stationary mixing machine comprising a double layered mixing structure having a first mixing element and a second mixing element body, wherein complex paths communicating between an inner (outer) portion of the body and an outer (inner) portion of the body are formed at an inside of the mixing body. A dispersion number with respect to the fluid paths along one direction (from the outer portion to the inner portion) and a dispersion number with respect to the fluid paths along an opposite direction (from the inner portion to the outer portion) are equal. A dispersion condition in which the fluid material is flown from a first (second) group of the chambers to a second (first) group of the chambers is uniform at all dispersion regions (along a peripheral direction) so that dispersed particles become very fine and uniform dispersion and uniform mixing can be accomplished. The total dispersion number is increased/decreased depending whether first section walls (second section walls) for dividing the first mixing chamber (the second mixing chamber) is increased/decreased so that a size of the mixing elements can be avoided for becoming larger.

A mixing element body of a stationary mixing machine is provided in fluid paths of the fluid material and has a double layered structure comprising a first mixing element portion and a second mixing element portion. A first opening is formed at a board of one of the mixing element portions. Mixing chambers communicating to the first opening are peripherally arranged at a boundary portion of the double-layered structure so as to surround the first opening. Groups of these chambers arranged in a peripheral direction are concentrically and circularly arranged. Under the condition, two mixing chambers are communicated each other through a step between each juxtaposed mixing chambers in a radius direction so as to provide shearing stress.

Further, the first mixing element portion of the double-layered body has the first opening and a first group of the mixing chambers. The first opening is provided at a first board. The first group of the mixing chambers form a first circular groove portion at the boundary surface, which is the double-layered body, for surrounding the first opening. In the first groove portion, a plural first section walls are radially arranged and the first section walls form a first mixing chamber.

The second mixing element portion comprises a second group of mixing chambers. The second group of the mixing chambers forms a second circular groove portion at a boundary surface of the double-layered body at a second board.

In the second groove portion, second section walls of which number is as same as the number of the first section walls are radially arranged. The second section walls form the second mixing chamber.

The second mixing chamber and the first mixing chamber are partly overlapped along a radius direction. The first opening is communicated to one of the first and second mixing chambers and the other of the first and second mixing chambers have a second opening for communicating an exterior portion. The first group of the mixing chambers of the first mixing element portion and the second group of the mixing chambers of the second mixing element portion are multi-layered and a position of the first section walls of the first mixing element portion and a position the second section walls of the second mixing element portion are coincident along a peripheral direction. The first section walls of the first mixing element portion and the second section walls of the second mixing element portion are alternatively provided at a constant interval along a peripheral direction.

The first board of the first mixing element portion or the second board of the second mixing element portion has a penetrated opening formed at an outer peripheral side of one of the boards so that the first bending chamber or the second mixing chamber is communicated to the penetrated opening without releasing with respect to the exterior portion or forms a second opening by radially arranging a plurality of section walls at the penetrated opening.

Each mixing chamber formed in the first mixing element portion and the second mixing element portion forms a groove portion at a boundary surface of the respective board of the double-layered body, wherein each groove portion are formed independently.

As a mixing element body of a stationary mixing machine, there is a mixing element provided in a fluid path and it is a double layered structure comprising the first mixing portion and the second mixing portion, wherein a first opening is formed at one of the mixing element portions and a cup shape casing is formed at another of the mixing element as a fluid path. At a crash surface confronting with the first opening of the mixing element portion, a mixing chamber communicated to the first opening is peripherally arranged. The circular groups of the mixing chambers are concentrically arranged. The mixing element body of the stationary mixing machine is characterized in that two mixing chambers are communicated each other through a step for applying shearing stress at a portion between juxtaposed mixing chambers in the group along a radius direction. By providing an inclined surface at a portion between the mixing chambers, a step can be provided at an outer peripheral portion of the mixing chamber. Alternatively, the step is provided at a portion between groups of the second mixing portion peripherally arranged.

THE BEST EMBODIMENT OF THE PRESENT INVENTION

Figure 1:
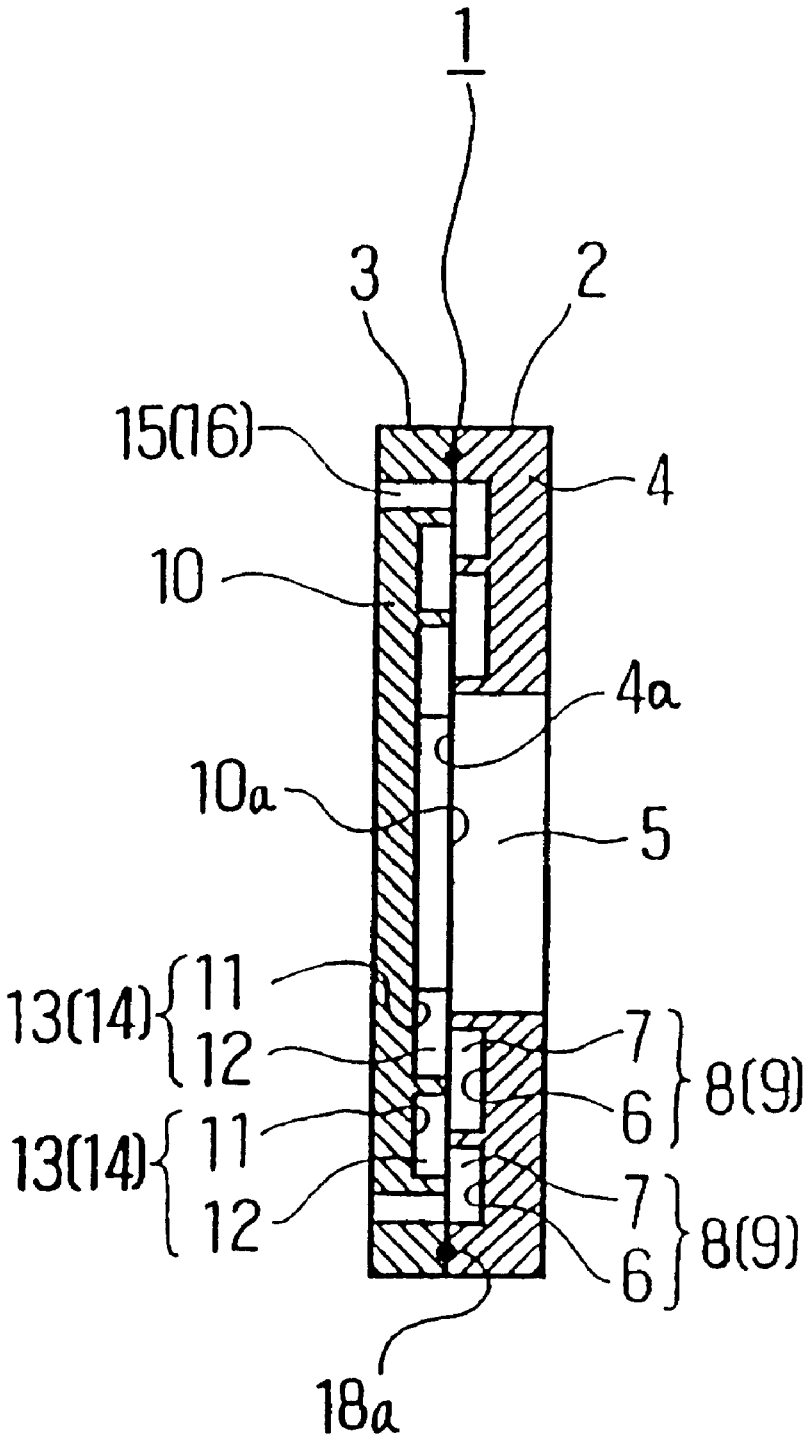
FIG. 1 shows a cross sectional view of a mixing element body of a stationary mixing machine according to the present invention.
Figure 2:
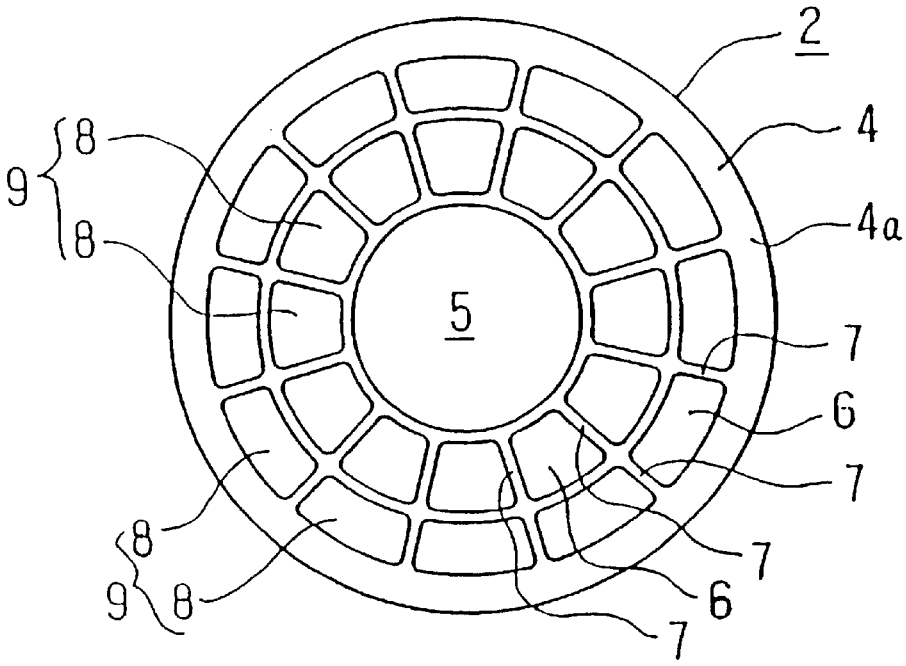
FIG. 2 shows a plane view of the first mixing element portion as a part of the mixing element body.
Figure 3:
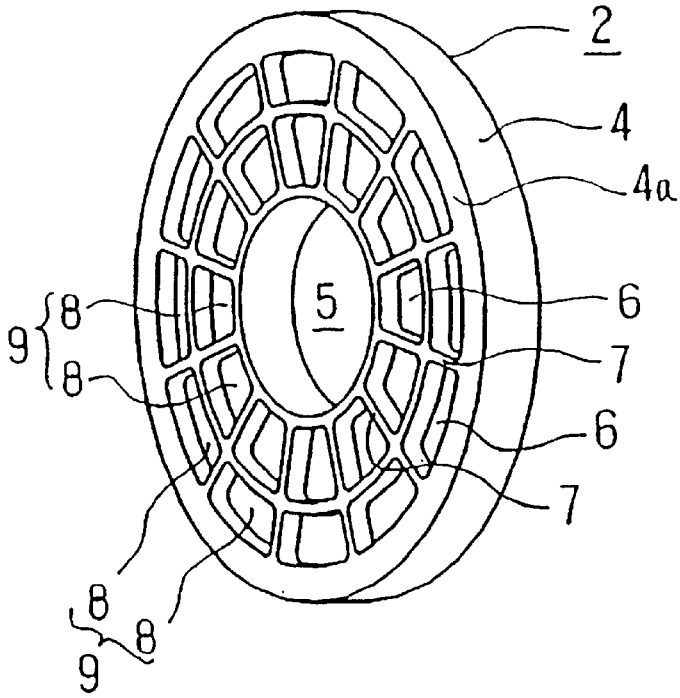
FIG. 3 shows a perspective view of the mixing element body as shown in FIG. 2.
Figure 4:
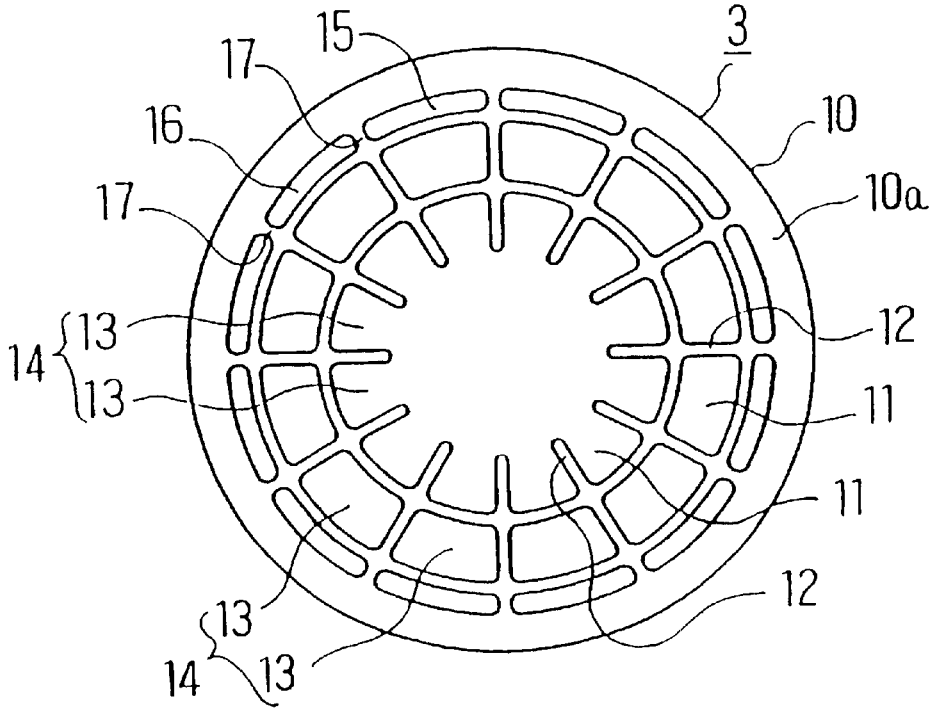
FIG. 4 shows a plane view of a second mixing element portion as a part of a mixing element body.
Figure 5:
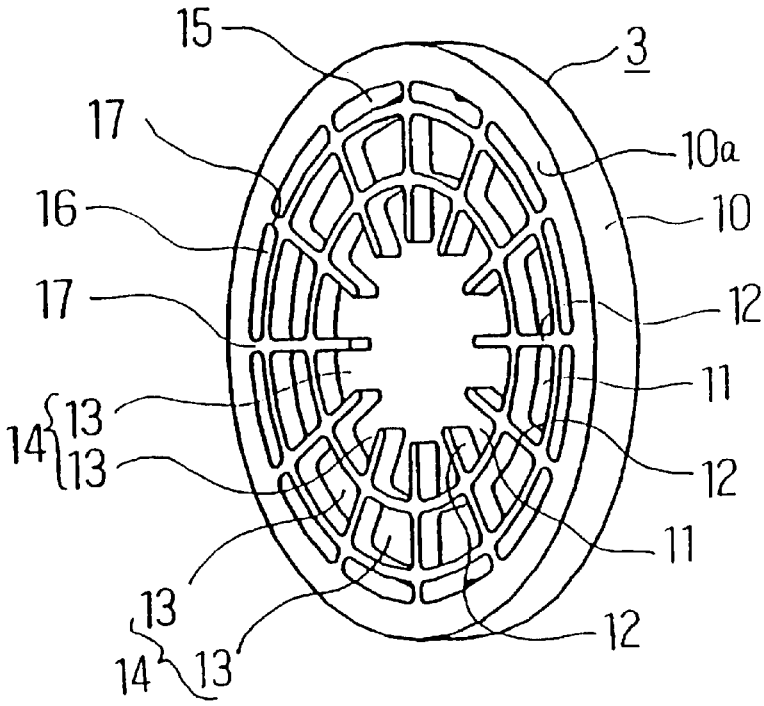
FIG. 5 shows a perspective view of the second mixing element as shown in FIG. 4.

A mixing element body 1 of a stationary mixing machine according to the present invention relates to one kind of an inline mixer for mixing various fluid materials such as a pair of liquid and liquid, a pair of air and liquid, a pair of air and air and a pair of solid and liquid. That is, a structure of a stationary mixing machine according to the present invention does not have a mechanic movable portion. Inventions recited in claims 1 to 8 are will be described in order with reference to FIG. 1 to FIG. 15. Inventions recited in claims 9 to 12 are will be described in order with reference to FIG. 16 to FIG. 20.

The mixing element body 1 has a double-layered structure in which a first mixing element portion 2 and a second mixing element portion 3 are comprised.

In the case that the first mixing element 2 and the second mixing element 3 are formed individually, these two element portions are concentrically overlapped. In the first mixing element portion 2, a first opening 5 is penetrated through a central portion of a disc shaped first board 4. At a boundary surface 4*a* of the double-layered structure as a laminated surface surrounding the first opening 5, a circular first groove portion 6 has a predetermined inner diameter, a predetermined outer diameter and a predetermined depth. A plurality of first section walls 7 are radially formed in the first groove portion 6 so as to divide into at least two first mixing chambers 8 along a peripheral direction by providing a first section wall 7. The first mixing chambers 8 form a group 9 of the first mixing chambers 9.

The latter second mixing element portion 3 has a circular second groove portion 11 having a predetermined inner diameter, a predetermined outer diameter and a predetermined depth at a boundary surface 10*a* of the double layered structure as an overlapped surface of a disc shaped second board 10. A plurality of second section walls 12 are radially formed in the groove portion 11, so as to divide a second mixing chamber 13 into at least two chambers coincident with the number of the first mixing chambers 8 along a peripheral direction by providing the second section walls 12. The second mixing chambers 14 form a group 14 of the second mixing chambers.

The first mixing chambers 8 (the second mixing chambers 13) are uniformly provided in the first groove 6 (the second groove 11) by arranging the first section walls 7 (the second section walls 12) so as to disperse fluid material uniformly along an outward radial direction and an inward radial direction.

A shape of the first board 4 and the second board 10 may not be circular. If the group 9 of the first mixing chambers 8 and the group 14 of the second mixing chambers 13 can be formed on a boundary surface 4*a* of the double layered structure and the boundary surface 10*a* of the double layered structure, any shape is acceptable. For example, it may be a polygon board more than a triangle board. Regarding the first groove portion 6 and the second groove portion 11, it may not be a circular shape in a plane view. If the first mixing chambers 8 and the second mixing chambers 13 can be uniform by providing the first section walls 7 in the first groove portion 6 or the second section walls 12 in the second groove portion 11, respectively, any polygon shape such as a triangle shape and the others can be acceptable.

Under the condition in which the second mixing chambers 13 of the second mixing element body portion 3 and the first mixing chambers 8 of the first mixing element body portion 2 are overlapped by concentrically juxtaposing the boundary surface 4*a* of the double layered structure and the boundary surface 10*a* of the double layered structure, a part of these surfaces are overlapped along a radius direction. That is, the group 9 of the first mixing chambers of the first mixing element body 2 and the group 14 of the second mixing chambers of the second mixing element body 3 form the first groove portion 6 and the second groove portion 11 having the different sizes, respectively. By overlapping an inner portion and an outer portion of the portions along a radius direction of the first groove portion 6 and the second groove portion 11, the first chambers 8 of the fist group 9 and the second chambers 13 of the second group 14 can be communicated.

Under the above communicated condition, the first section walls 7 of the first group 9 of the first mixing chambers and the second section walls 12 of the group 14 of the second mixing chambers are alternatively arranged along a peripheral direction by shifting an angle. Preferably, when fluid material is uniformly dispersed in an inward radius direction and an outward radius direction, the first section walls 7 and the second section walls 12 are alternatively provided at a constant interval along a peripheral direction. With respect to each first mixing chamber 8 and each second mixing chamber 13, the first section walls 7 and the second section walls 12 are positioned at a center portion, respectively so as to communicate one of the first mixing chambers 8 and two second mixing chambers 13 and one of the second mixing chamber 13 and two first mixing chambers 8, respectively.

By coinciding with a position of the first section walls 7 of the group 9 of the first mixing chambers and a position of the second section walls 12 of the group 14 of the second mixing chambers, one first mixing chamber 8 may be communicated to one second mixing chamber 13.

Numbers of the,group 9 of the first mixing chambers of the first mixing element body portion 2 and the group 14 of the second mixing chambers of the second mixing element portion 3 may be solo. In order to repeat the dispersion and improve a mixing ratio by increasing the total dispersion number, a plurality of the groups 9 of the first mixing chambers and the groups 14 of the second mixing chambers may be concentrically formed.

The first opening 5 is communicated to a chamber (chambers) of the group 9 of the first mixing element body 2 or a chamber (chambers) of the group 14 of the second mixing element body 3, which is located at the most position. The second opening 15 connected to an exterior portion is provided at an outermost chamber (chambers) of the group 9 of the first mixing element portion 2 and the group 14 of the second mixing element portion 3 (see FIG. 8 and FIG. 9).

In an embodiment of the group 9 of the first mixing chambers and an embodiment of the group 14 of the second mixing chambers, outside walls and inside walls of the first groove portion 6 and the second groove portion 11 are not provided so as to be released and communicate with the first opening 5 and the second opening 15.

In another embodiment, a penetrated opening 16 is provided at the first board 4 of the first mixing element body 2 or the second board 10 of the second mixing element body 3 along an outer peripheral direction with respect to the group 9 of the first mixing chambers or the group 14 of the second mixing chambers formed at the outermost portion. Alternatively, a plurality of section walls 17 may be radially formed at the penetrated opening 16 (see FIG. 10 and FIG. 11).

Although the first mixing element portion 2 and the second mixing element portion 3 are explained as the disc shape first board 4 and the disc shape second board 10 which are separately formed, a variation of the embodiment is not limited. For example, a board may be divided to at least two sections (not shown) at an appropriate portion along a thick direction and/or a peripheral direction and the sections may be adhered or welded so as to combine the sections integrally. Casting, compression or injection molding is acceptable to form the sections integrally. In such a case, the boundary surface 4*a* of the double-layered structure and the boundary surface 10*a* of the double-layered structure may be virtually. Regardless the body integrally formed or combined from a plurality of sections, the body may have the above-described shape in the final stage.

Figure 10:
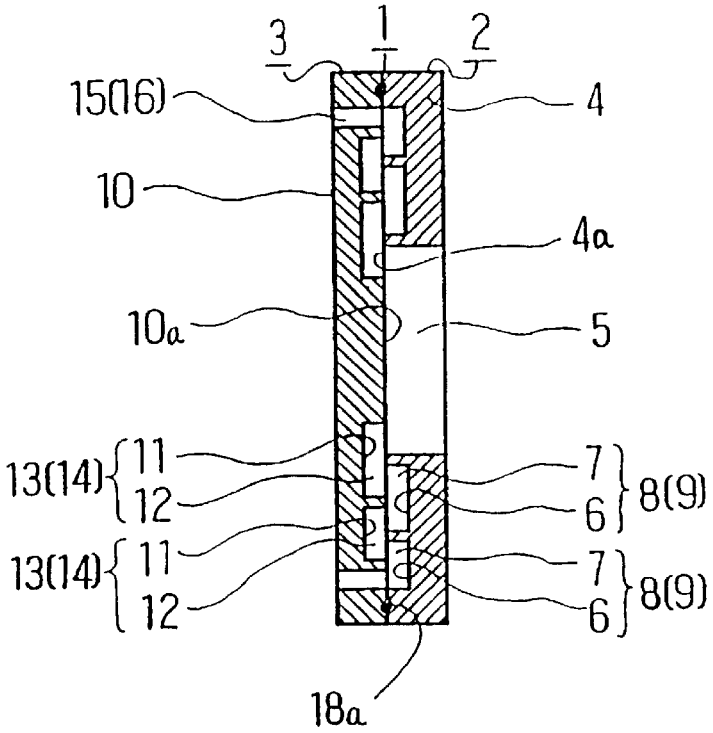

There are a lot of variations about the mixing element body 1. One case is a mixing element body 1 connecting to a pipe (not shown) for flowing fluid material as a stationary mixing machine wherein one of the first opening 5 and the second opening 15 may be connected to an inlet port and the other may be connected to an outlet port. Another case is a mixing element body 1 as shown in FIG. 1 and FIG. 10, wherein the first opening 5 and the second opening 15 are concentrically positioned. If an inlet direction and an outlet direction are the same directions, a plurality of the mixing element bodies 1 can be connected, wherein the first openings 5 or the second openings 15 are connected to each other in the mixing element bodies 1 arranged in a front-rear direction.

Depending on performance and characteristics of mixed fluid materials, a mixed degree, a purpose and utility of mixing, the fluid mixing machine may have a sealing device 18 at a necessary portion so as to avoid for leaking fluid material from an unnecessary portion. For example, a black circuit is indicated in the drawing.

In another embodiment, a mixing element body 1 of a stationary mixing machine is affected as a fluid path in a fluid path structure body 19. The above fluid path structure body 19 comprises a round shaped cylinder 20 and cap members 21 for sealing the both openings of the round shaped cylinder 20, wherein an inlet 22 and an outlet 23 is formed at a central portion of the cap members 21, respectively and detachably attached to the round shaped cylinder 20 through the sealing device 18a for preventing the fluid material from leaking.

Figure 12:
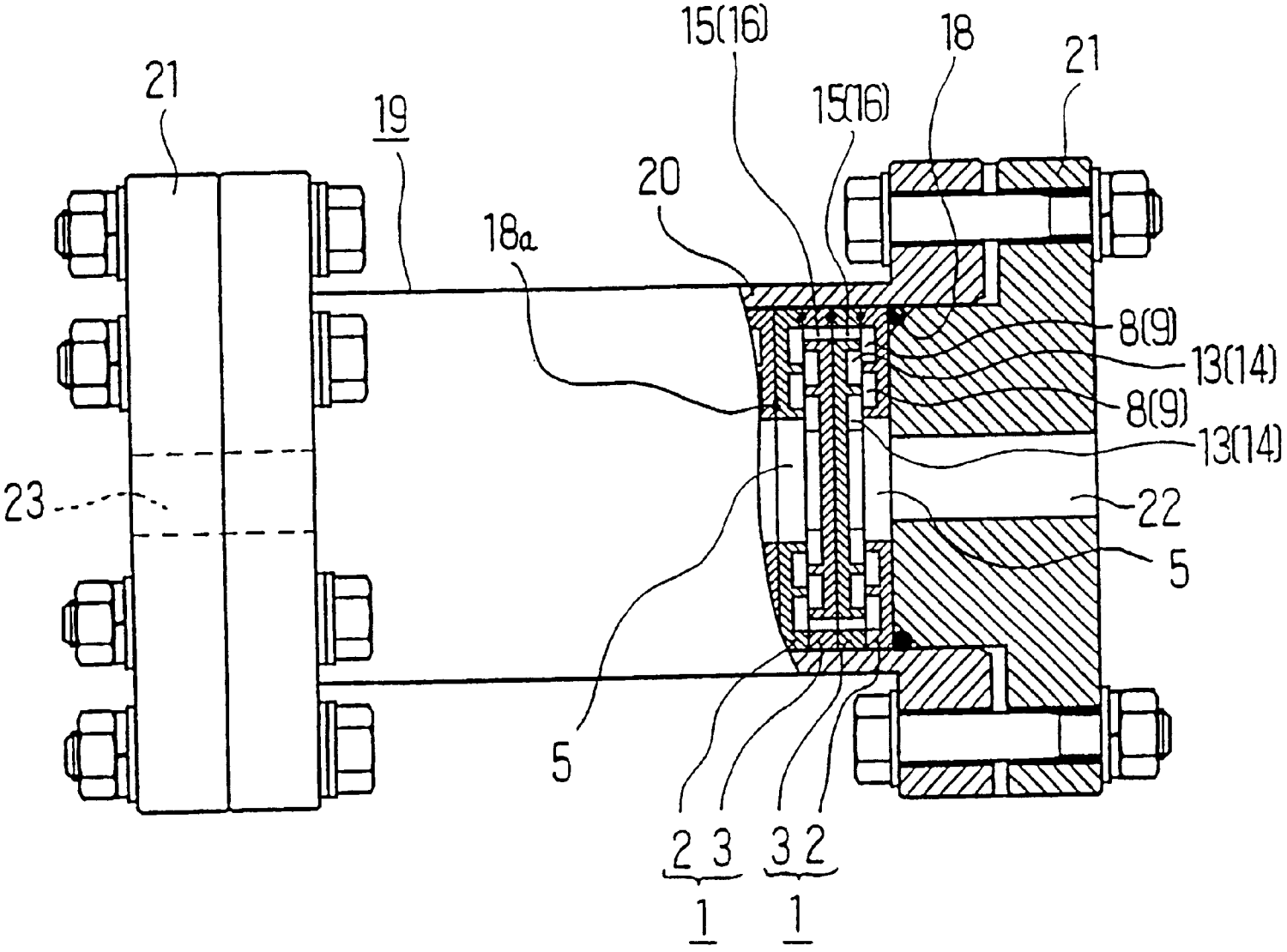
FIG. 12 is a cross sectional view of a stationary mixing machine in which a mixing element body is provided in a fluid path.

An arrangement of the mixing element body 1 in the fluid path structure body 19 is shown in FIG. 12, wherein the first opening 5 or the second opening 15 are connected each other, the first opening 5 is connected to the inlet 22 and the second opening 15 is connected to the outlet 23.

Figure 13:
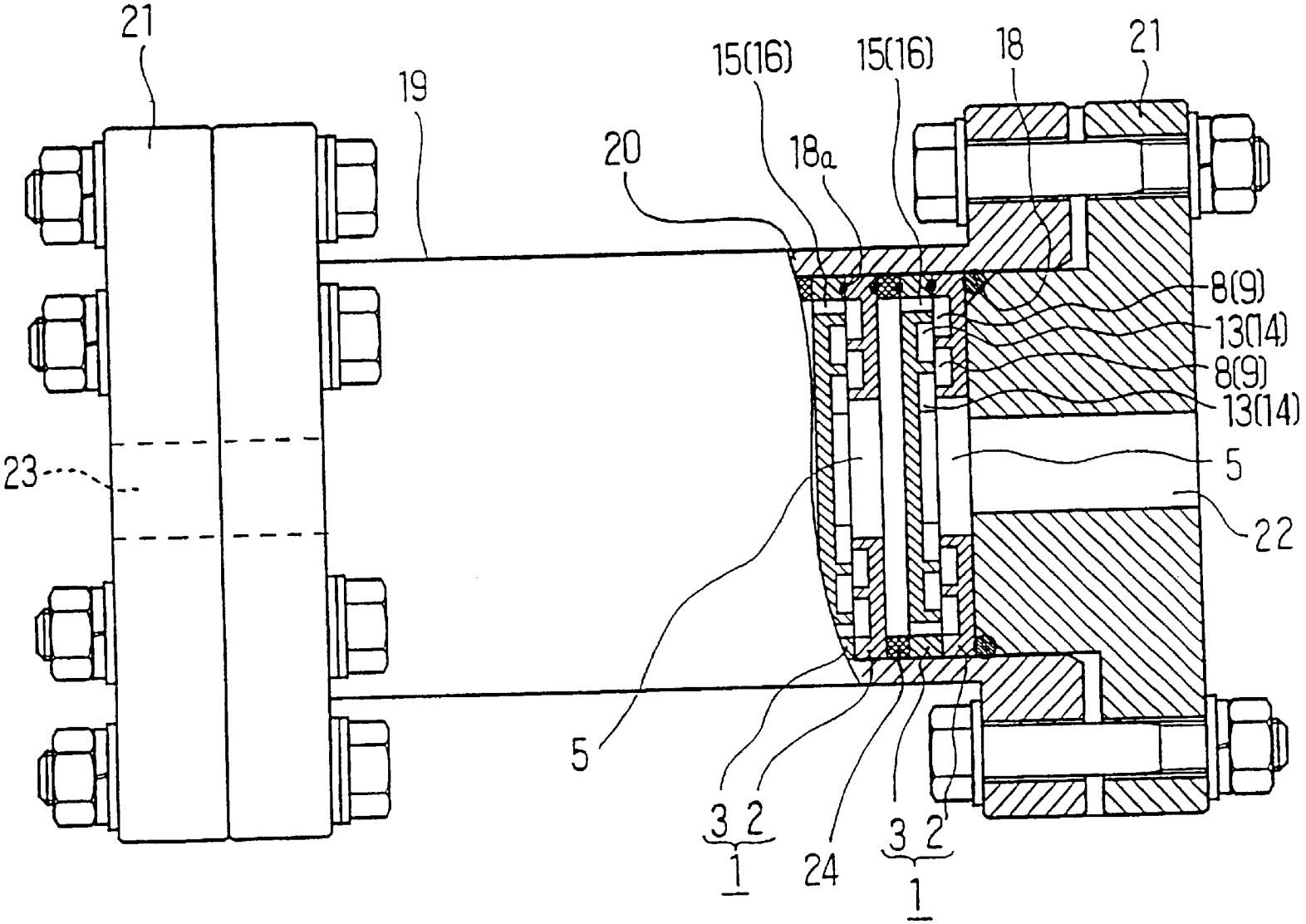
FIG. 13 is a cross sectional view of another stationary mixing machine.

In another embodiment as shown in FIG. 13, a ring shaped spacer 24 is inserted among the mixing element bodies 1 so as to connect the first opening 5 of the down stream mixing element body 1 and the second opening 15 of the up stream mixing element body 1. Further, the first opening 5 is connected to the inlet 22 and the second opening 15 is connected to the outlet 23.

Figure 8:
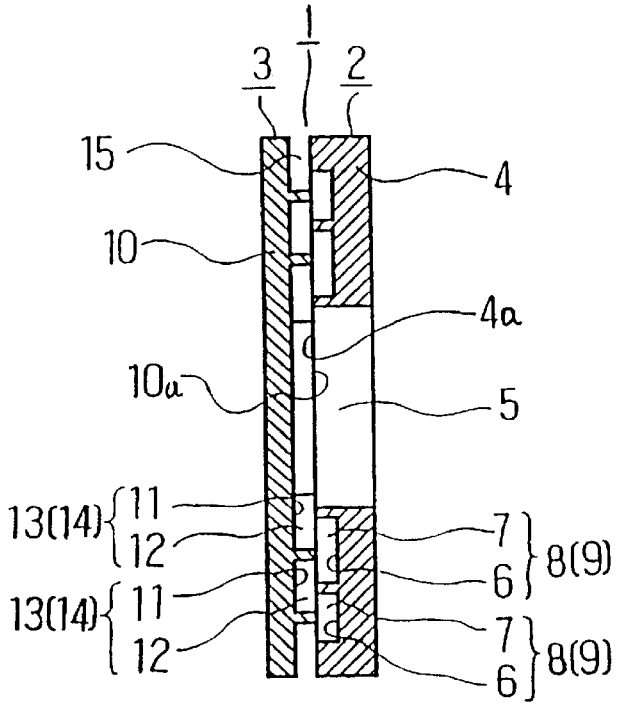
FIGS. 8, 9, 10 and 11 shows across sectional view of other embodiments of a mixing element body, respectively.
Figure 9:
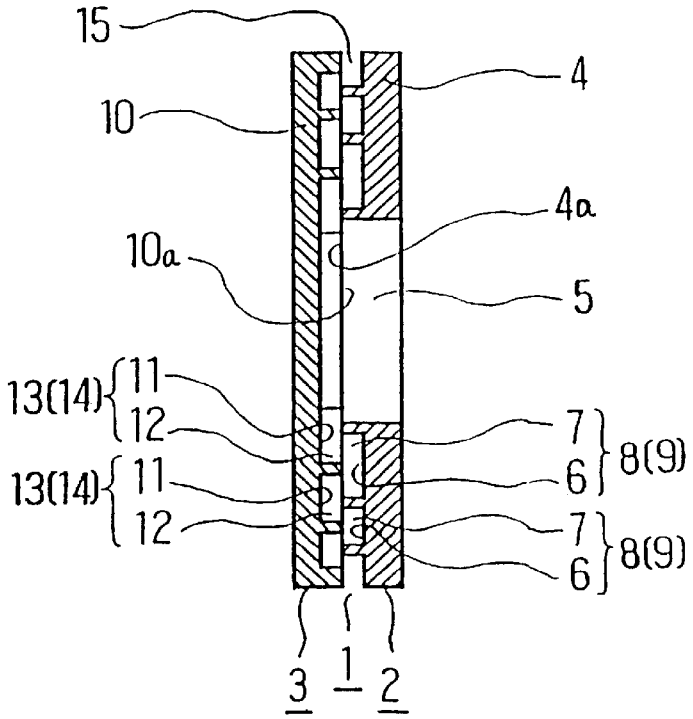

In the case of arranging the mixing element body 1 as shown in FIG. 8 and FIG. 9 in the fluid path structure body 19, an outer diameter of the mixing element body 1 is designed wherein a fluid path M as shown in the conventional stationary mixing machine is formed at an inner peripheral side of the cylinder 20 of the fluid path structure body 19 so as to flow out/into fluid material through the second opening 15 (not shown). For example, in the case that the first mixing element portion 2 or the second mixing element portion 3 of the mixing element 1 are overlapped at their back sides, a fluid path M may be formed between an outer peripheral side of the second mixing element portion 3 of the mixing element body 1 and an inner peripheral side of the cylinder 20.

In the next, an operation of the mixing element body 1 according to the present invention will be described. In the mixing element body 1, one of the first opening 5 and the second opening 15 may be an inlet and the other may be an outlet. While fluid material is flown trough a complex fluid path formed between the group 9 of the first mixing chambers and the group 14 of the second mixing chambers in the mixing element body 1, the fluid material is dispersed and mixed.

Figure 6:
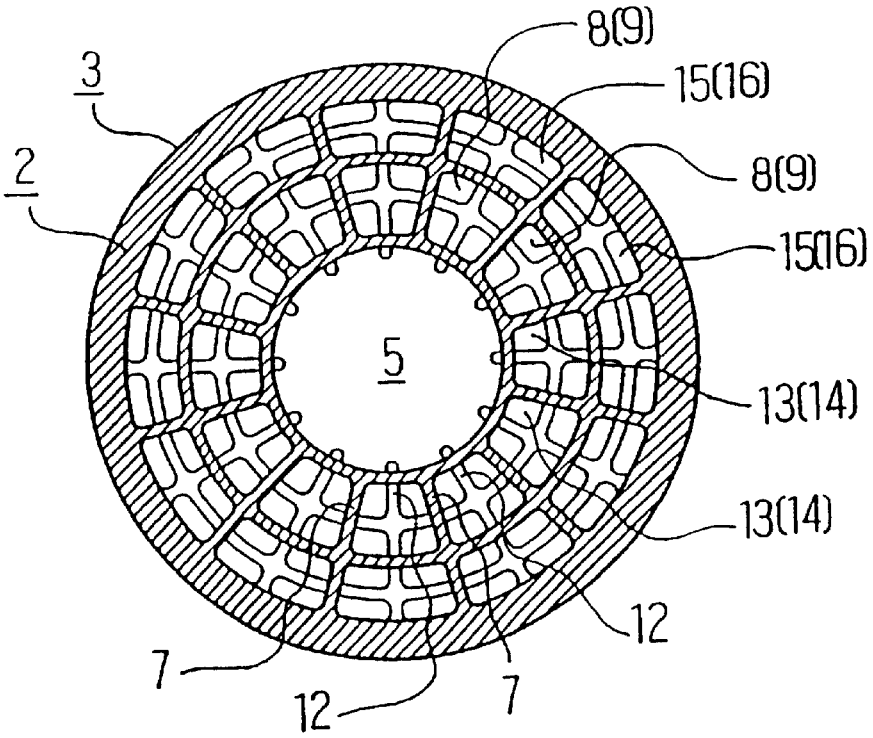
FIG. 6 is an embodiment for showing a communication between a first mixing chamber and a second mixing chamber.

In the embodiment of the mixing element body as shown in FIG. 1 and FIG. 6, in the case that one of the first mixing chambers 8 or the second mixing chambers 1.3 is connected to two second mixing chambers 13 or two first mixing chambers 8, if an inlet is the first opening 5, fluid material is dispersed by a plurality of second mixing chambers 13 (twelve chambers in the drawing) juxtaposed to the first opening 5. Then, the fluid material is deflected by an outer wall of the second groove portions 11 of the second mixing chamber 13 and flown into two juxtaposed first mixing chambers 8 confronted with the second mixing chamber 13. Further, the fluid material is deflected by an outer wall of the first groove portions 6 of the first mixing chambers 8 and flown into two second mixing chambers 13 confronted with one first mixing chamber 8. By repeating such a dispersion action, the dispersed and mixed fluid material is flown out from the second opening 15 connected to an exterior portion along a direction as same as the inlet direction in the final.

The second opening 15 is formed at the penetrated hole 16 by the section walls 17 so that the fluid material can be dispersed depending on a number of openings divided by the section walls 17 in the case that the fluid material is flown from the second mixing chamber 8 to the second opening 15 at the final.

On the contrary, in the case that an inlet is the second opening 15, a direction of the fluid material is merely reversed. The total dispersion number is not influenced by a fluid direction at all. A fundamental dispersion and a mixing effect in the case of the reverse flowing direction is as similar as that in the case of the right flowing direction.

Figure 11:
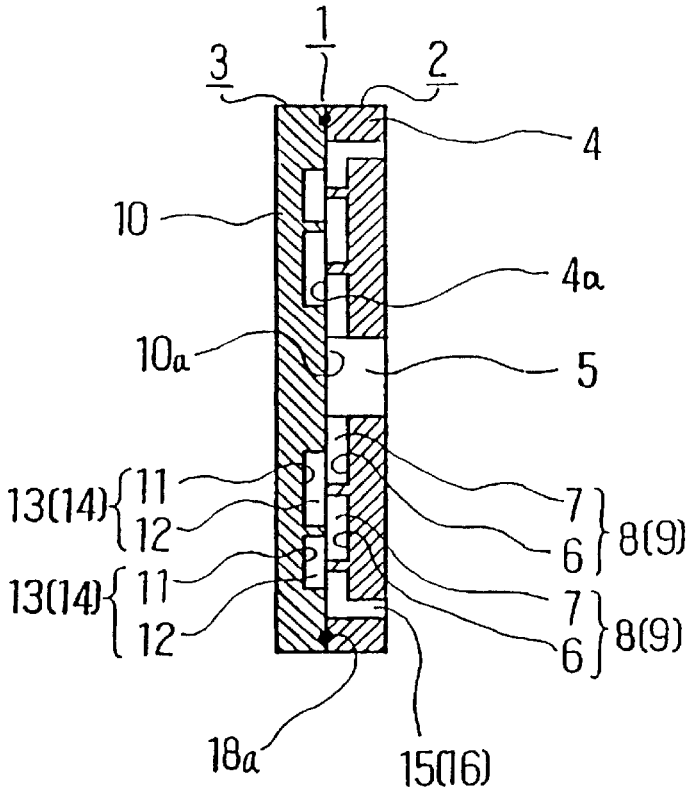

In an embodiment of the mixing element body 1 as shown in FIG. 11, the almost function and effect are as similar as the above cases except the following point. A chamber into which the fluid is flown is the first mixing chamber 8 and the fluid inlet direction and the fluid outlet direction are opposite each other.

Figure 7:
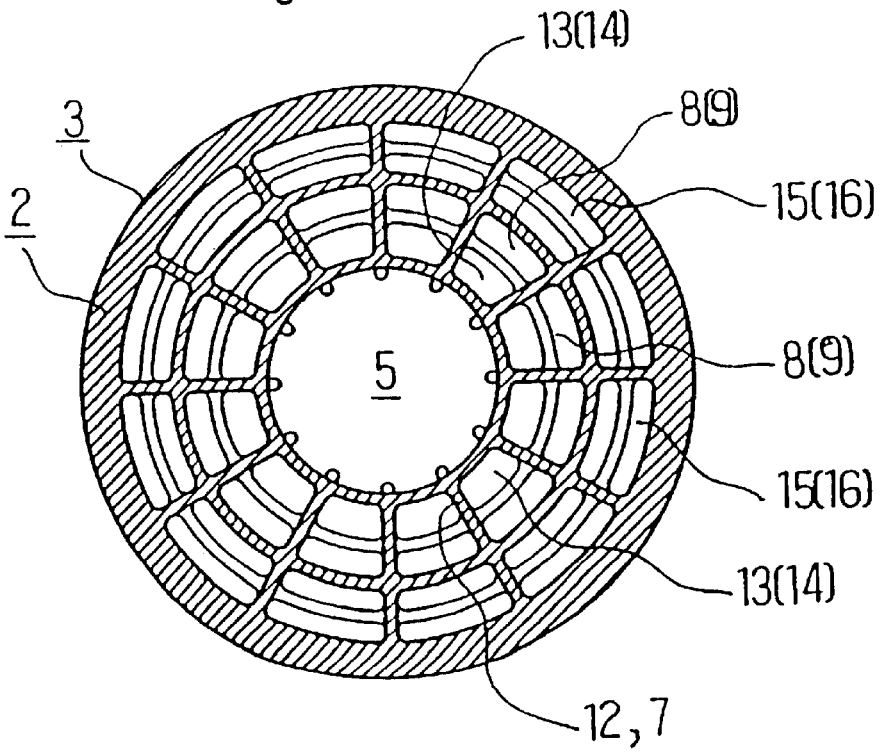
FIG. 7 shows another embodiment for showing a similar communication.

In an embodiment of the mixing element body 1 as showed in FIG. 7 wherein one first mixing chamber 8 is connected to one second mixing chamber 13. If an inlet is the first opening 5, the fluid material is flown to a plurality of the second mixing chambers 13 (twelve chambers in FIG.

7) juxtaposed to the first opening 5. Then the fluid material is deflected by an outer wall of the second groove portion 11 of the second mixing chamber 13 and flown into one mixing chamber 8 juxtaposed with the second mixing chamber 13. Further, an outer wall of the first groove portion 6 of the first mixing chamber 8 deflects the fluid material. The fluid material is flown into one second mixing chamber 13 juxtaposed the first mixing chamber 8. By repeating such an action, the dispersed and mixed fluid material is flown out from the second outlet 15 connecting to an exterior portion wherein the fluid outlet direction is as same as the fluid inlet direction.

On the contrary, in the case that an inlet is the second opening 15, the fundamental effect and function is as similar as the above embodiment except a point that a direction of the fluid material is reversed. In the embodiment of the mixing element body 1, the first mixing element portion 2 and the second mixing element portion 3 are separate and concentrically overlapped. Position of the first section walls 7 of the group 9 of the first mixing chambers and positions of the second section walls 12 of the group 14 of the second mixing chamber 14 may be arranged alternatively along a peripheral direction or coincided with each other. Thereby, in the case of the same mixing element body 1, the total dispersion number can be varied.

As described above, an embodiment according to the present invention has a double-layered structure including the first mixing element portion 2 and the second mixing element portion 3. The first mixing portion 2 forms the first opening 5 at the first board 4. At a boundary surface 4*a* of the double-layered structure surrounding with the first opening 5, a circular first groove 6 is formed. In the first groove portion 6, a plurality of the first section walls 7 are radially formed so that a group 9 of the first mixing chambers 8 can be formed by divided a chamber into a plurality of chambers with the first section walls 7.

The second mixing member portion 3 forms a circular second groove 11 at a boundary surface 10*a* of the double-layered structure of the second board 10. In the second groove portion 11, the second section walls 12 of which number is as same as the number of the first section walls 7 are radially formed so that a group 14 of the second mixing chambers 13 can be formed by dividing a chamber into a plurality of chambers with the second section walls 12. The second mixing chambers 13 and the first mixing chambers 8 are partly overlapped along a radius direction so that the first opening 5 can be connected to one of the first mixing chamber 8 and the second mixing chamber 13 and the other of the first mixing chamber 8 and the second mixing chamber 13 is connected to an exterior portion as the second opening portion 15. If the fluid material is flown in an inward radial direction or an outward radial direction, the fluid material flows in the same condition since number of chambers of the group 9 of the first mixing chambers 8 and that of the group 14 of the second mixing chambers 13 are the same along the inward radial direction and the outward radial direction. Regardless the flowing directions, the same dispersion and a mixing effect can be obtained in accordance with the same total dispersion number. Since a concentration phenomenon occurred at a conventional mixing machine can be avoided, dispersed particles become very fine and it is not happed a conventional case in which a dispersed (divided) number of the fluid material is different depending on chambers. The dispersion number is always constant so that uneven dispersion and a mixing action caused by the difference of the dispersion number among the mixing chambers can be avoided and a mixing performance can be remarkably improved compared to that of the conventional mixing machine.

The total dispersion number can be simply varied by increasing/decreasing number of the first section walls 7/second section walls 12 for dividing one chamber into a plurality of the first mixing chambers 8/second mixing chambers 13. A size of the mixing element body 1 does not become big. It is different from the conventional case. Even if the mixing element portions have the same shape, the mixing element body 1 can vary the total dispersion number. A free degree of the designed total dispersion number of the stationary mixing machine in which the mixing element body 1 is provided in the fluid path structure body 19 so that the mixing degree can be easily adjusted corresponding to various fluid materials.

A plurality of groups 9 of the first mixing element portion 2 and the groups 14 of the second mixing portion 3 are formed so that the total dispersion number can be remarkably increased corresponding to the number of groups 9 and 14. Regardless the number of groups 9 and 14, the dispersed particles can become very fine and a uniform mixing effect is not influenced.

Positions of the first section walls 7 of the first mixing element portion 2 and positions of the second section walls 12 of the second mixing element portion 3 are arranged to coincide each other along a peripheral direction so that a cross sectional area of the fluid path can become maximum. Thereby, the mixing element body 1 can increase a fluid speed and a fluid amount with a reduction of a pressure loss in the flowing operation.

The first section walls 7 of the first mixing element portion 2 and the second section walls 12 of the second mixing element portion 3 are alternatively arranged along a peripheral direction at a constant interval so that the mixing element body 1 can disperse the fluid material uniformly during a dispersion operation in addition to the above described effects.

A penetrated opening 16 is peripherally arranged at an outer side of the first board 4 of the first mixing element portion 2 and the second board portion 10 of the second mixing element portion 3. The first mixing chambers 8 or the second mixing chambers 13 is connected to the penetrated opening 16 as the second opening 15 instead of connecting to an exterior portion. If the second opening 15 is provided at the first board 4 of the first mixing element portion 2, a flow-out direction can be reverse with respect to a flow-into direction. If the second opening 15 is provided at the second board 10 of the second mixing element portion 3, the mixing element bodies 1 can be linearly connected. Thereby, dispersion and a mixing performance of one mixing element body 1 can be remarkably improved.

The second opening 15 is formed by radially providing a plurality of section walls 17 at the penetrated opening 16. Depending on a number of openings divided by the section walls 17, the flowing-out fluid material is further dispersed and mixed so that a dispersion performance of the mixing element body 1 based on the dispersion total number can be improved.

Regarding a mixing performance of the stationary mixing machine according to the present invention, its detailed mechanism is not clear since a three-dimensional movement of the fluid material is too complicated. However, a model of the mixing process is shown in FIG. 14.

Figure 14:
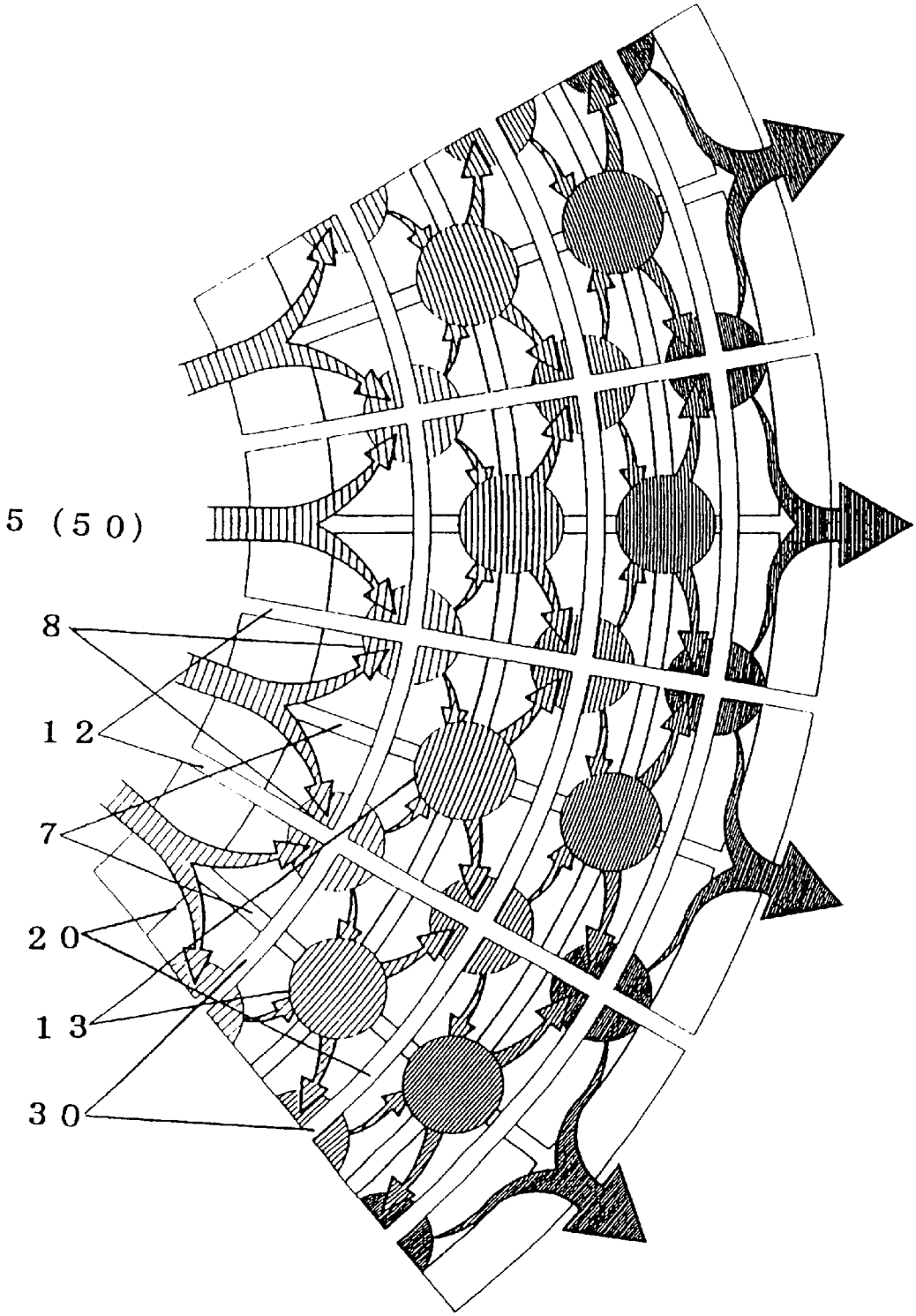
FIG. 14 shows mixing process of the mixing element body according to the present invention.

As shown in FIG. 14, the fluid material flown from one of the openings 5 of the first mixing element portion is deflected by a bottom surface 50 of the second mixing element body so that the fluid material flows along a radial direction as shown in an arrow along the bottom surface 50. The section walls 12 and deflected by the outer wall 30 disperse the fluid material. By stepping over the outside wall 20 of the first mixing chambers 8, the fluid material is dispersed by the section walls 7, concentrated with adjacent dispersed fluid material and then flown to the mixing chambers 8 so as to be mixed. Further, the outer walls 20 located at an outside of the mixing chambers 8 and flown toward the second mixing chambers 13 deflect the fluid material. By stepping over the outside walls 30, the fluid material is dispersed by the section walls 12, concentrated with adjacent dispersed fluid material and flown into the mixing chambers 13. The above operation is repeated during a mixing process.

As described above, in the mixing process of the mixing machine according to the present invention, mixing chambers formed at the boundary surface of the double-layered structure of the mixing element body make a group of the mixing chambers peripherally arranged. These groups are concentrically arranged. In the pair of the mixing element portions, the respective group of the mixing chambers is shifted along a radius direction and a peripheral direction. Thus, each mixing chamber can connect to two mixing chambers along the radius direction. At each portion between rows of respective groups, the outside walls provide a step so that shearing stress is applied to the fluid material. While the fluid material is flown through the mixing chambers concentrically arranged along an inward radius direction and an outward radius direction, repeating the dispersion and applying the shearing stress operate a mixing process.

In the stationary mixing machine, groups of the mixing chambers formed by the groove portions in the pair of the mixing element portions are peripherally arranged and the groups are concentrically and circularly arranged. Under the condition in which the pair of mixing element portions are concentrically overlapped, the groups overlapped along a radius direction and alternatively shifted along a peripheral direction with a predetermined angle so as to communicate each other. Thus, the mixing process can be accomplished.

A fine dispersion operation caused by these dispersion and the shearing stress is uniform by a mixing effect of the large total dispersion number related to these groups of the mixing chambers so that uniform fine dispersed particles having a constant particle diameter can be obtained along the whole flowing path.

Judging from the mixing process and the basic structure described above, although the groove portions for constituting the mixing chambers formed by the section walls and the outside walls are described, a variation thereof is not limited. Even if a shape and a structure of the groove portion are modified, the similar functions for being satisfied with the above mixing process and a fundamental relative positions in the mixing chambers could be obtained.

Figure 15A:
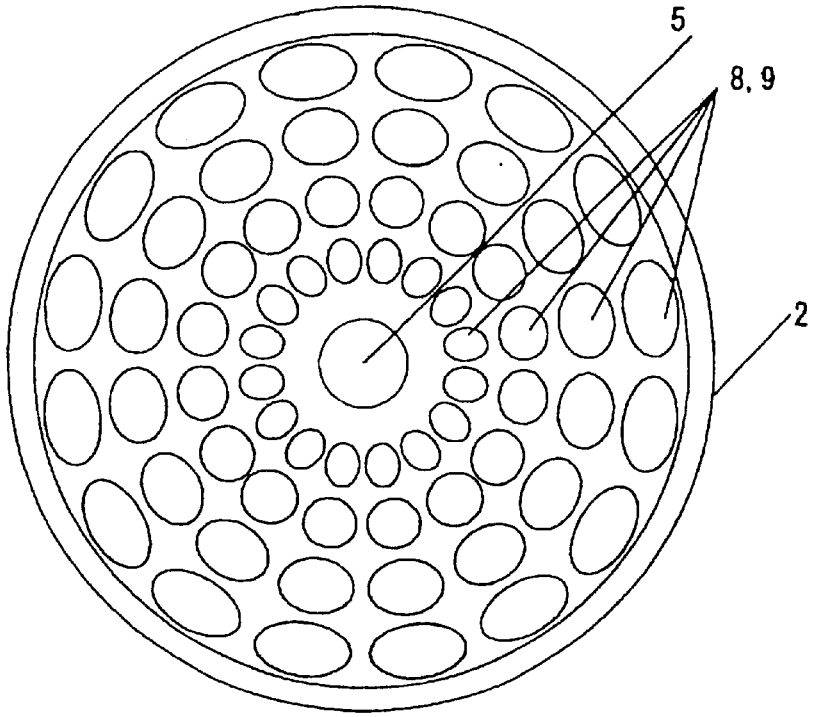
FIG. 15(A) and FIG. 15(B) shows a plane view of other embodiments according to the present invention, respectively.
Figure 15B:
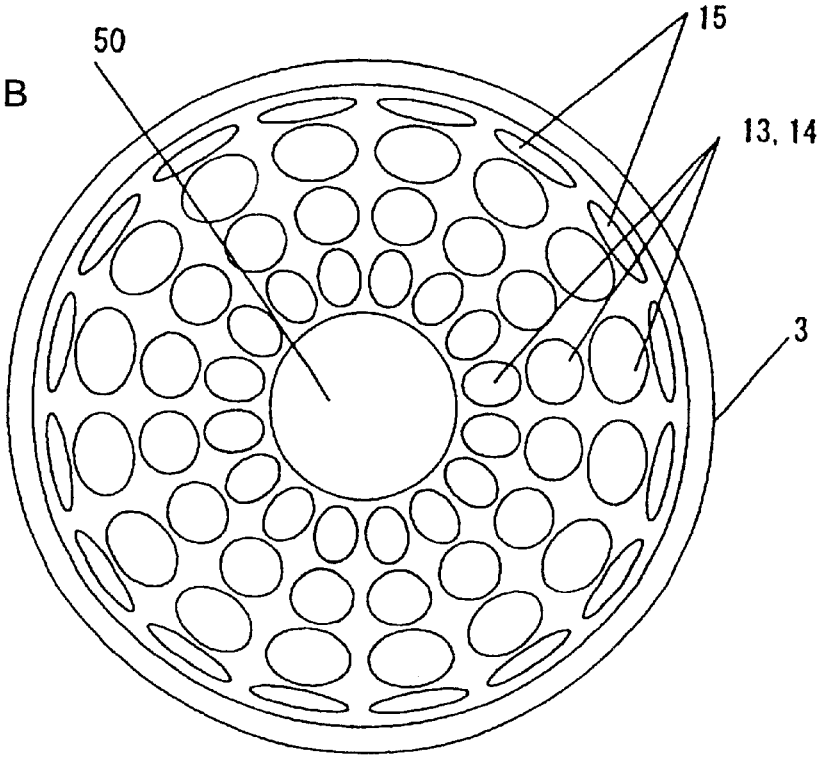

For example, as shown in FIG. 15(A) and FIG. 15(B), a shape of the grooves, which form the mixing chambers 8 and 13 formed on the board of the mixing element portions 2 and 3, may be an oval or a square with round corners in a plane view. A round maybe provided at a corner in a cross sectional view. The depth of the groove portion may be varied along the radius direction. These may be designed independently each other. As clearly described in the above mixing process, each mixing chambers 8, 13 and groups 9 and 14 are arranged along a peripheral direction and concentrically and circularly arranged wherein each mixing chamber is connected to two mixing chambers located at a front side and a rear side with respect to the each mixing chamber and a step for applying shearing stress may be provided at a portion between the groups of the mixing chambers.

In such a case, the shearing stress caused by a step provided at a portion between the groups of the mixing chambers is accomplished it purpose by providing an outside wall of each mixing chamber along the radius direction.

In the above-described case, the fluid material is alternatively flown to a portion between the mixing chambers formed by the groove portion formed on each one of the pair of the boards of the mixing element portions. The mixing process may be operated by providing the mixing chambers on one of the pair of the mixing element portions.

Figure 16:
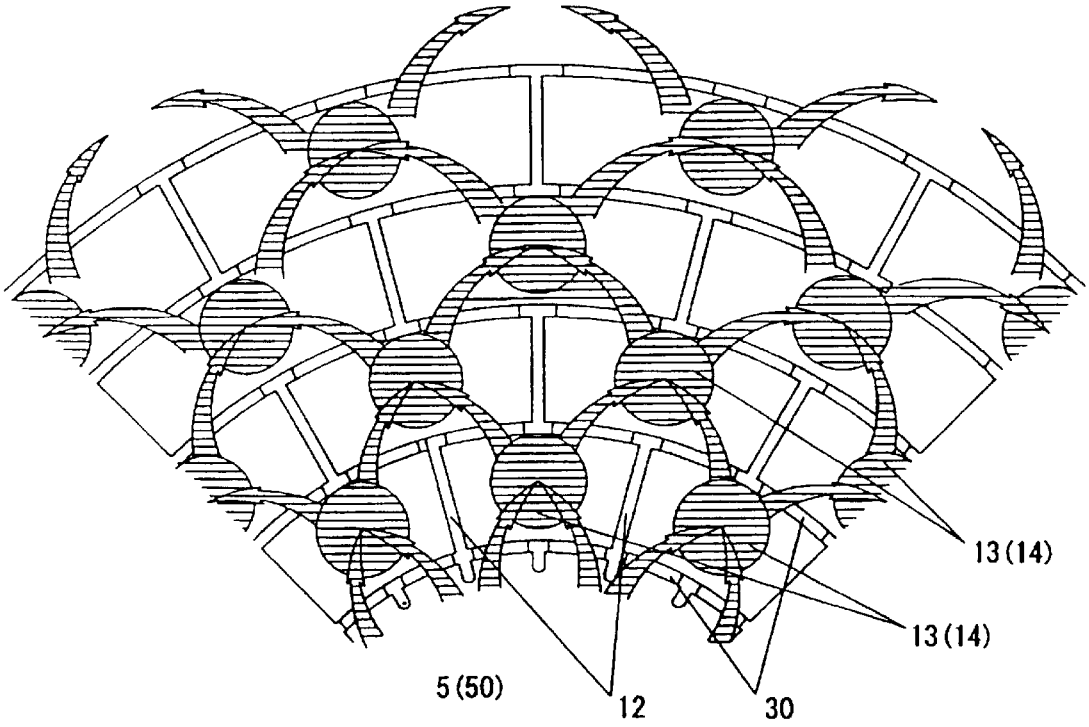
FIG. 16 shows a modified mixing process of the mixing element portion according to the present invention.

FIG. 16 shows an, embodiment in which the mixing chambers formed by the groove portions are formed at only one of the pair of the mixing element portions. In FIG. 16, the mixing chambers 13 are formed at the board of the second mixing element portion. Fluid material flown from the opening 5 provided at a central portion of the confronted first mixing element portion is radially flown as indicated as an arrow as shown in the drawing along the bottom surface 50 of the mixing chambers. The fluid material is dispersed by the section walls 12 and stepped over the step portions 30 of the mixing chambers. By concentrating with the adjacent dispersed fluid material, the combined fluid material is flown into the mixing chambers 13 and mixed. By repeating these steps, the mixing process is promoted. The above-described mixing process is substantially equal to that of the embodiment wherein the pair of the mixing elements is concentrically overlapped.

In order to form a fluid path or a mixing chamber among the mixing element portions, it is necessary to provide a member for sealing each mixing chamber and a fluid path between the mixing chambers. One of the pair of the mixing elements is a cup-shaped casing with respect to the mixing chamber, which is a fluid path of mixed fluid material or a wall surface of the mixing chamber. As described in the above example, the step portion 30 is formed as a partition wall for dividing a mixing chamber into a plurality of mixing chambers in a radial direction. A clearance is provided between a ceiling and the casing by cutting a part of the partition wall so as to communicate to a mixing chamber at the adjacent raw. That is, a step is necessary at a portion between a mixing chamber and a mixing chamber in the adjacent raw. It is acceptable a model in which a partition is provided between the mixing chambers and a step is provided in the same group of the mixing chambers or a model in which the mixing chambers in the adjacent rows are formed by providing a step at a portion between the group and the adjacent group.

Figure 17A:
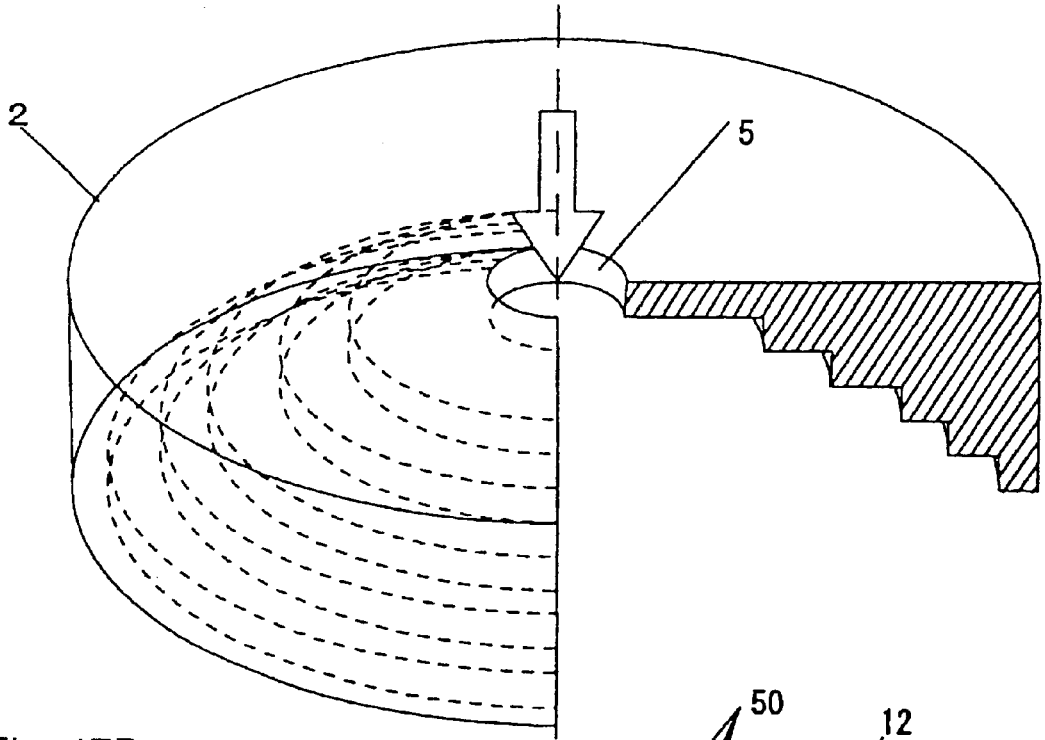
FIG. 17(A) and FIG. 17(B) show a perspective view of the embodiment based on the mixing process as shown in FIG. 16.
Figure 17B:
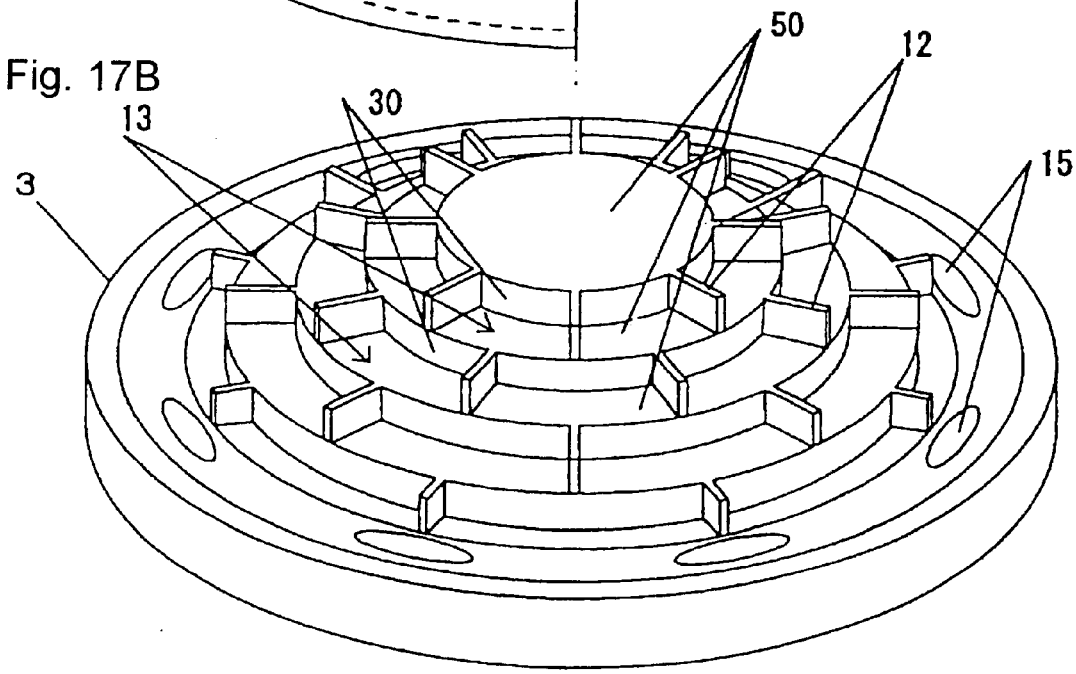

An example is shown in FIG. 17(A) and FIG. 17(B). As shown in the drawings, the respective section wall 12 divides adjacent mixing chambers in a group of the step-shaped mixing chambers. In the stationary mixing machine, the fluid material from into the opening 5 of the mixing element body 2 is deflected by the bottom surface 50 of the confronted mixing element portion 3. The fluid material is radially flown along the bottom surface toward a peripheral direction. The section walls 12 disperse the fluid material and a shearing stress is applied to the fluid material by providing the step 30. Then the fluid material in a region is concentrated with a dispersed fluid material from the adjacent region and flown into the mixing chamber 13 together in the next row so as to be mixed. By repeating this process, the above-described mixing operation can be accomplished.

In a mixing machine with a group of step-shaped mixing chambers, its fluid resistance is less than and the fluid speed and amount are larger than other examples in which the fluid material is flown over the outside wall formed between the mixing chambers in a part of the mixing element portions.

Figure 18A:
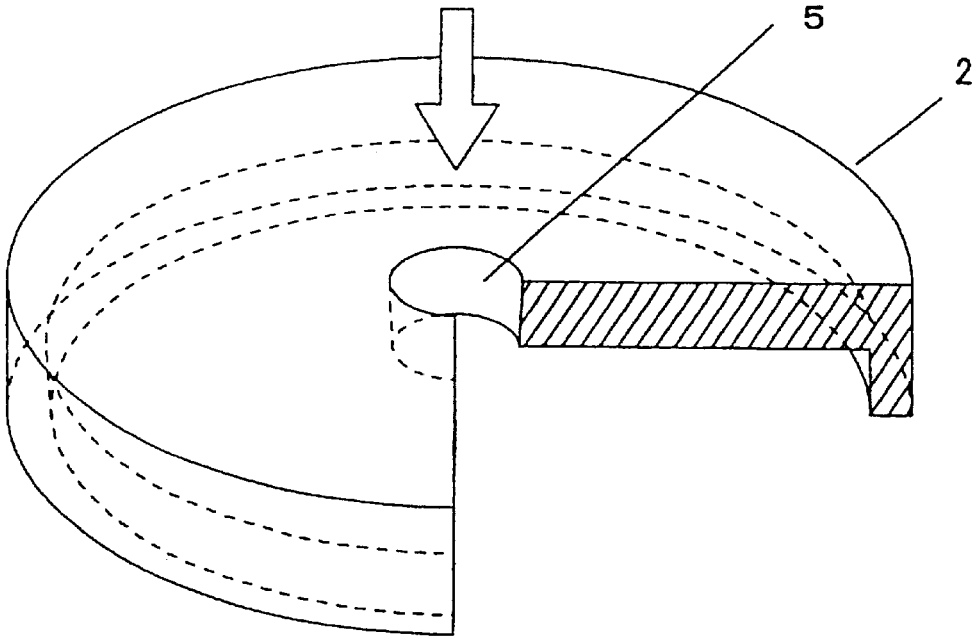
FIG. 18(A) and FIG. 18(B) show another embodiment according to the present invention based on the mixing process as shown in FIG. 16.
Figure 18B:
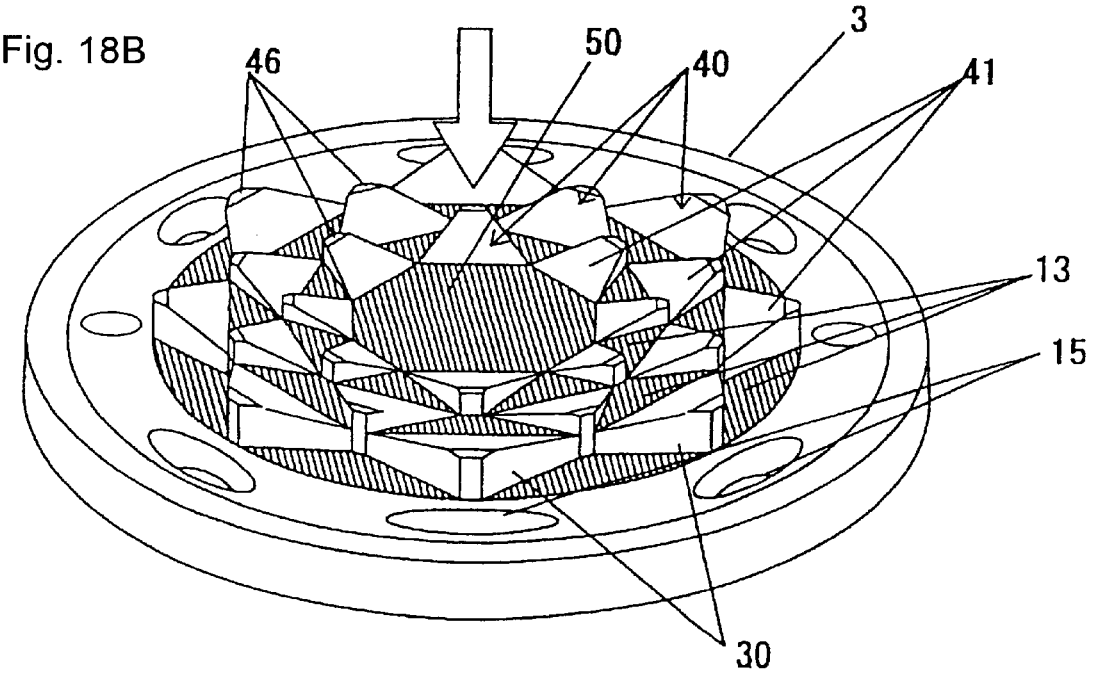

In an example as shown in FIG. 18, a partition 40 having an inclined surface 41 is peripherally formed at each portion between mixing chambers. A step 30 is provided at an outer peripheral side of the partition 40. A mixing chamber 13 is formed a space between the bottom surface of a partition 40 and an adjacent partition in the next row and a casing contacting with a top surface 46 of the partition. The inclined surface 41 deflects a flowing direction of the fluid material toward a tangential line of an outer periphery of the group of the mixing chamber so that the fluid material is crashed with the fluid material from the adjacent mixing chamber and the combined accelerated fluid material can be flown to a mixing chamber in the next row. As the result, the mixed fluid material becomes finely dispersed fluid material by a two liquid crashing operation and a bottom surface crashing operation with respect to the bottom surface and wall surfaces 41. In the case of a liquid-liquid mixing operation, fine emulsion condition can be accomplished.

In the case of forming the mixing chambers by providing steps between the group and the adjacent group, each group of the mixing chambers are arranged in a step style. The section wall 12 or a partition 40 for providing a step between a mixing chamber in a row and a mixing chamber in the adjacent row so that the fluid material flown into the next row can be divided into two portions divides a portion between adjacent mixing chambers.

Figure 19A:
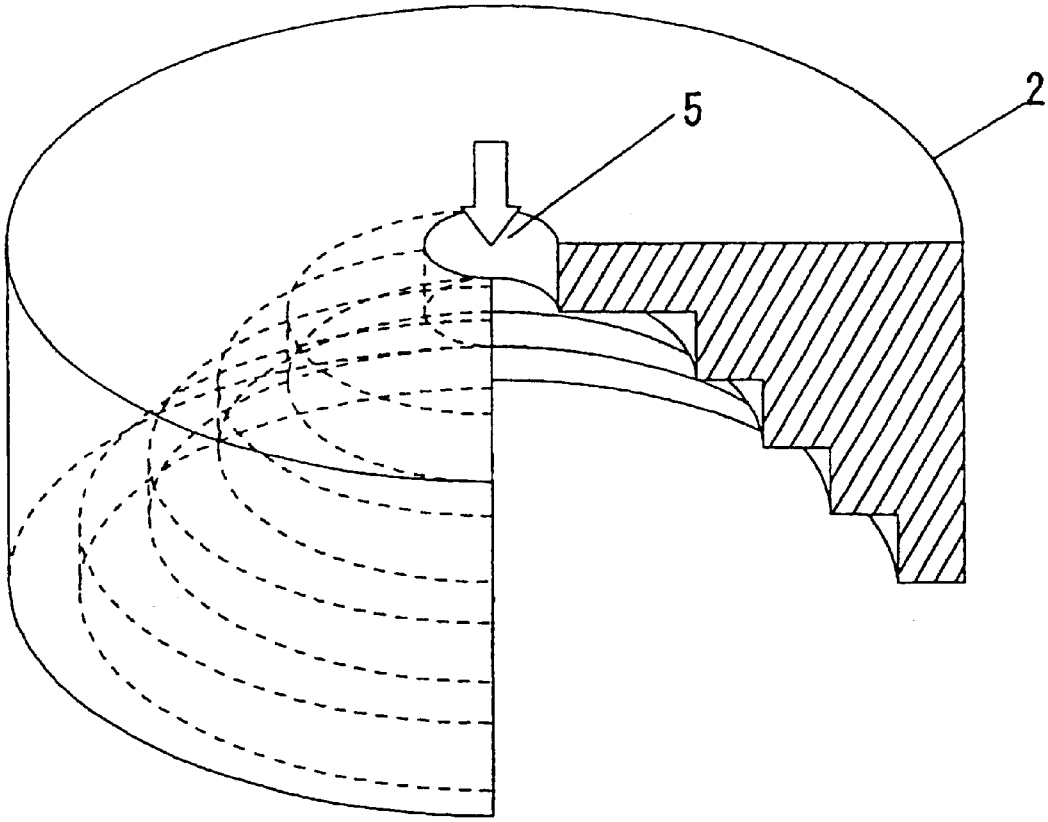
FIG. 19(A) and FIG. 19(B) show another embodiment according to the present invention based on the mixing process as shown in FIG. 16 and are a perspective view of a mixing machine with a dispersion function, wherein a step is provided at each portion between adjacent groups of mixing chambers concentrically arranged.
Figure 19B:
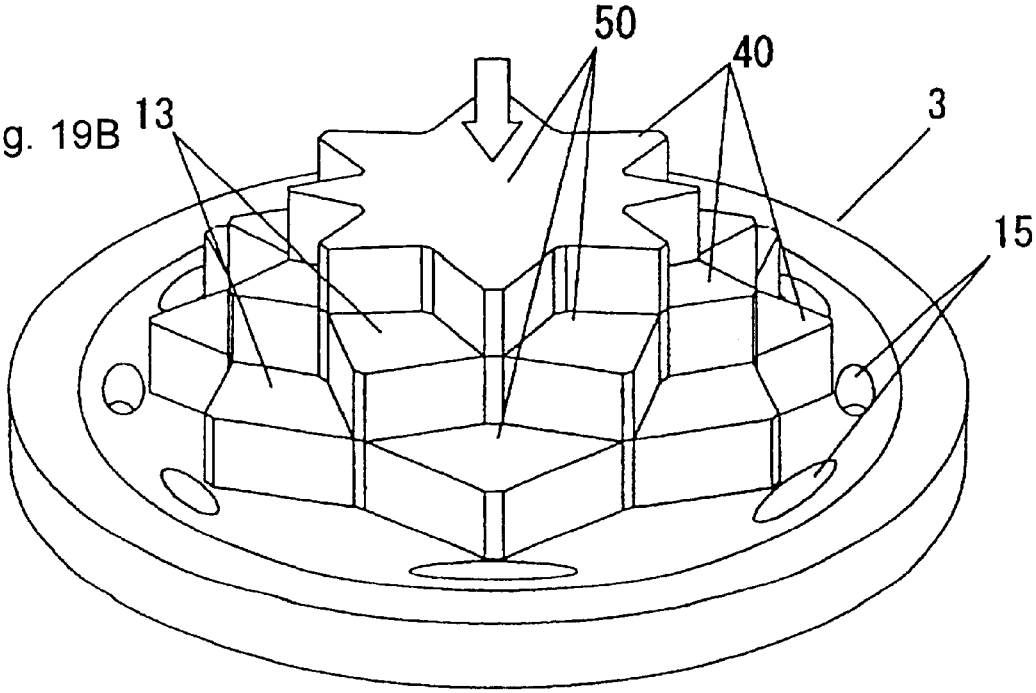

FIG. 19 is another embodiment according to the present invention. Although a basic structure of the embodiment is almost similar to the embodiment as shown in FIG. 18, the embodiment as shown in FIG. 19 has the partition 40 extended from a bottom surface which forms a step at a portion between a mixing chamber and an adjacent mixing chamber. A bottom surface 50 is a horizontal surface by adjusting the inclined surface 41 of the partition 40 in the embodiment as shown in FIG. 17 so as to form the inclined surface 41 integral with the bottom surface. As the result, each bottom surface 50 is arranged in a step style so as to form a crash surface.

The movement of the fluid material is basically equal to that of the embodiment as shown in FIG. 18. Pressurized fluid material flown from the opening 5 of the mixing element body 2 is deflected a right angle (90°) toward the radius direction by the crash surface 50. The partition 40 and deflected toward a peripheral direction divides the fluid material. The combined fluid material is accelerated and crashed to the bottom surface 50 of the partition 40 at the next step.

When the bottom surface of the partition 40 divides the mixed fluid material into two mixing chambers, the mix fluid material is finely dispersed by the crashing operation with respect to the wall surface. The crashed fluid material is deflected toward a tangential line with respect to the outer peripheral and combined with the fluid material in the adjacent mixing chamber in accordance with a two-liquid crashing method. By repeating an acceleration operation by combining two fluid materials and flown to the next mixing chamber, the dispersion is operated effectively.

In accordance with these embodiments, the present invention can provide a mixing element portion having a simple structure that can be produced simply and a high hardness. In view of cleaning treatment, excellent effect can be obtained.

Figure 20:
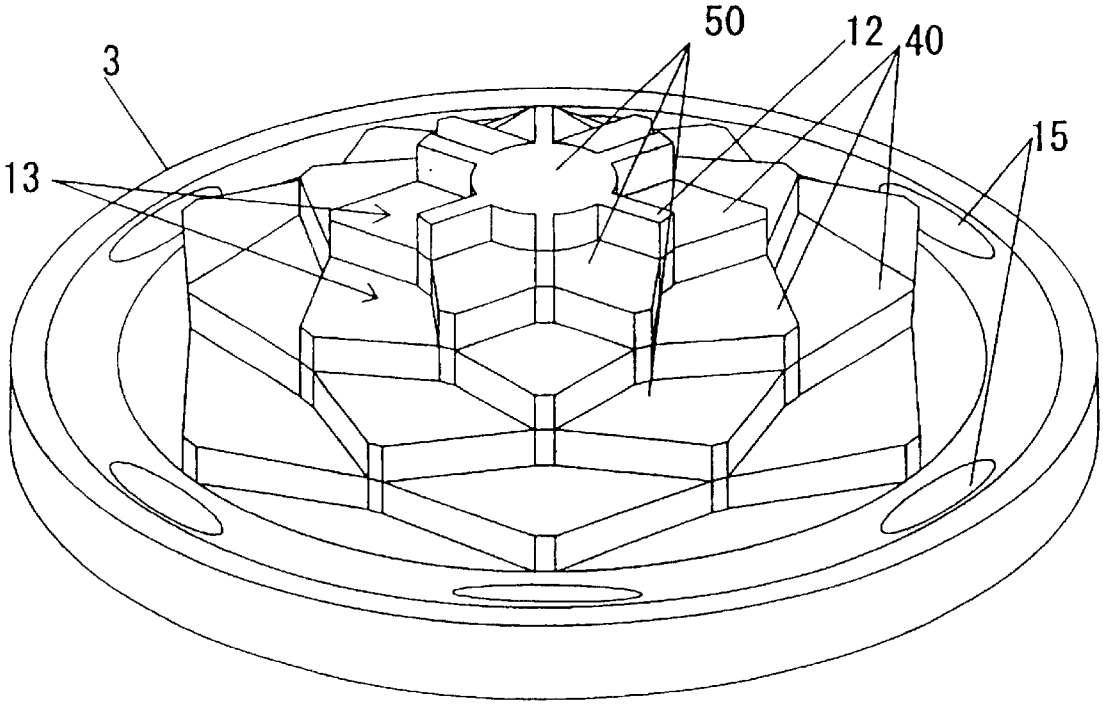
FIG. 20 is a perspective view of another embodiment according to the present invention based on a mixing process as shown in FIG. 16 wherein a step formed between the adjacent groups of the mixing chambers and a section wall are combined.
Figure 21:
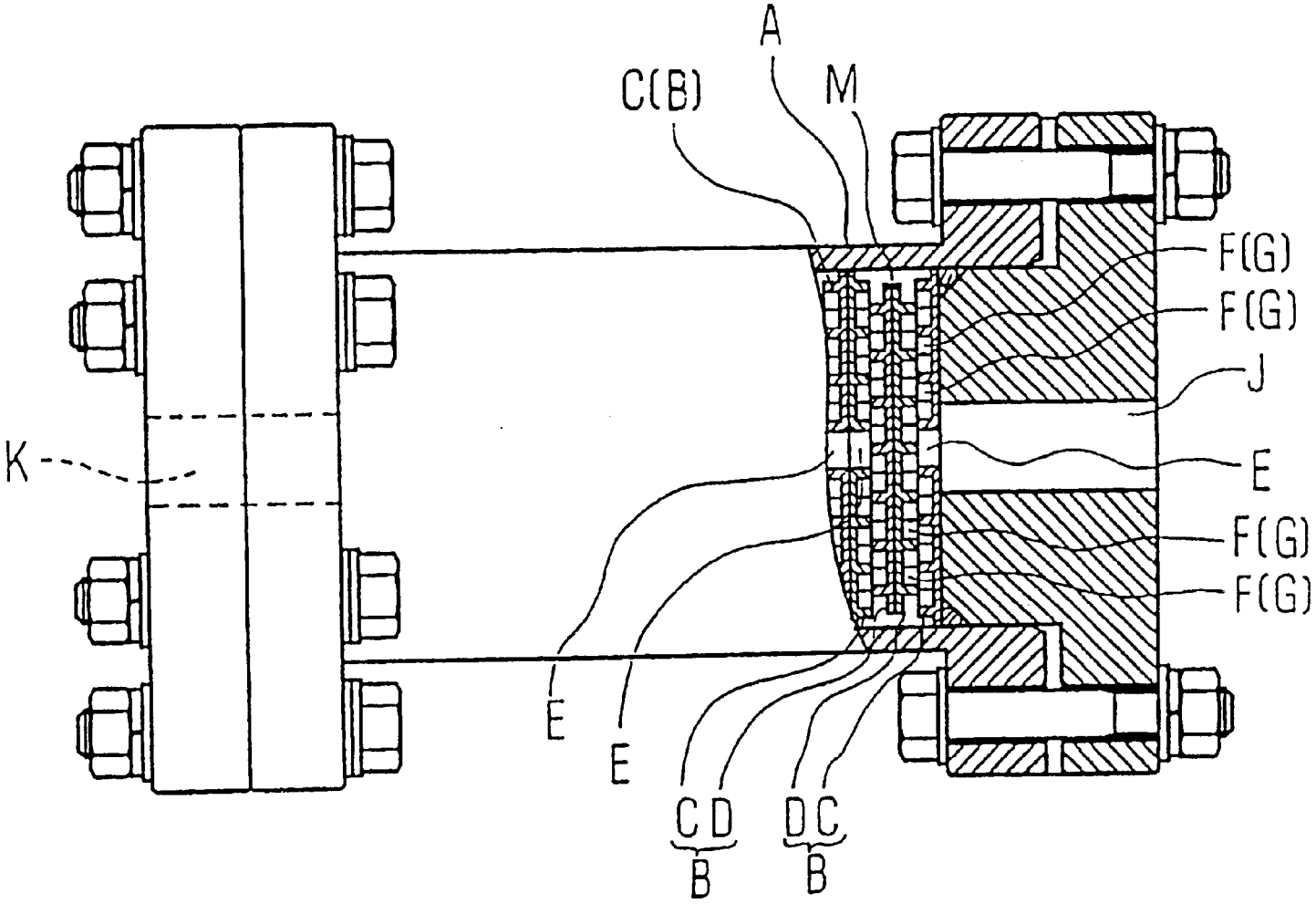
Fig.21 (PRIOR ART)
FIG. 21 shows a cross sectional view of an inside structure of a conventional stationary mixing machine.
Figure 22:
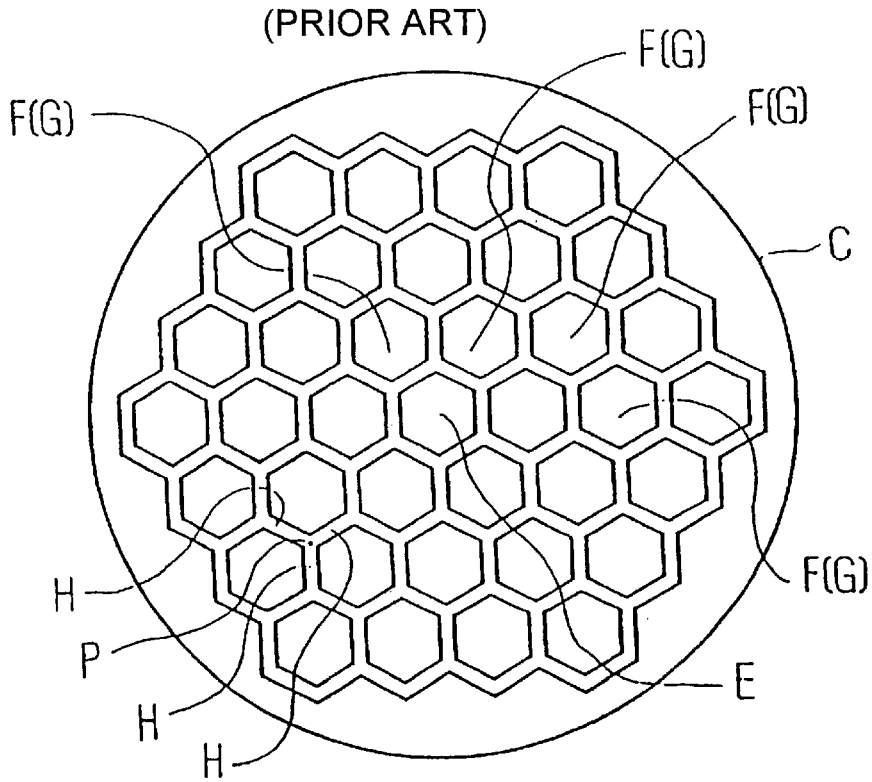
Fig.22 (PRIOR ART)
FIG. 22 and FIG. 23 show a front view of a large disc and a small disc of a mixing element of the stationary mixing machine as shown in FIG. 21, respectively.
Figure 23:
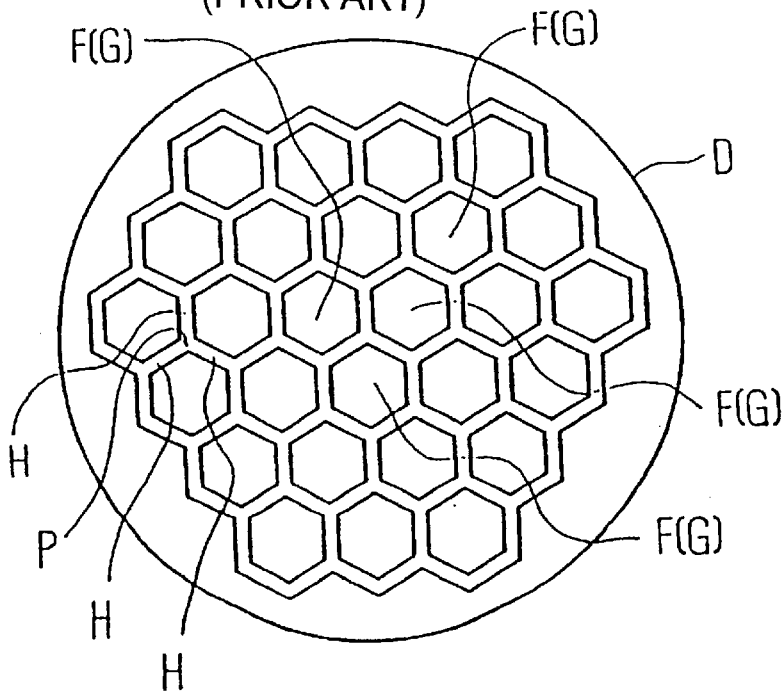
Fig.23 (PRIOR ART)
Figure 24:
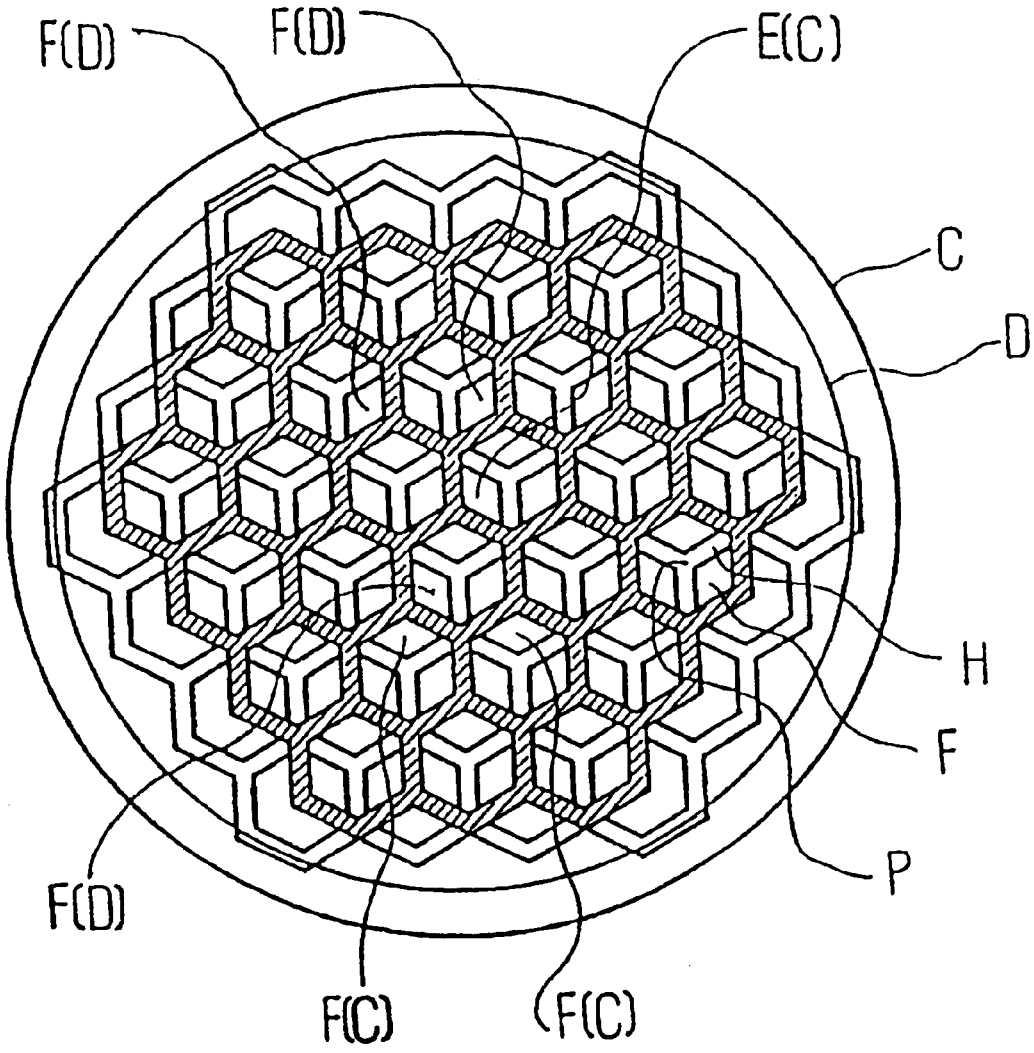
Fig.24 (PRIOR ART)
FIG. 24 shows a communication between chambers of a mixing element of the stationary mixing machine.

FIG. 20 is another embodiment according to the present invention. A structure of the mixing element body 2 is substantially equal. Therefore, hereinafter, it will be only described about a mixing element portion 3. In the embodiment, number of the partition 40 arranged along a peripheral direction is 6 that are less than that of the former embodiment. The section wall 12 is provided by extension of an outer periphery of the respective crashing surface 50. A fluid control function of the section wall 12 introduces the fluid material to the mixing chamber in the next step. Under the condition, the fluid resistance is reduced while a fluid speed and a fluid amount are increased. Thus, a pair of liquid and air, a pair of liquid and liquid can be effectively dispersed. Numbers of the section walls and partition can be varied depending on characteristics such as kind and viscosity of fluid material. The various fluid controls are accomplished by adjusting an arrangement and a structure of the partition.

Although there are described embodiments according to the present invention having the features with reference to the drawings, a shape and a structure of a mixing chamber for dispersing the mixed fluid material and applying shearing stress in a fluid path formed at a portion between the mixing element portions 2 and 3 can be modified to other basic structure described above. A shape, location and number of these mixing chambers can be varied corresponding to characteristics, utility and a diameter of dispersed particles in any combination of air and liquid or liquid and liquid.

For example, shearing stress applied to the fluid material among the mixing chambers can be controlled by adjusting a size of a step of the partitions, an inclined surface of the partition and a height of a step and a cross sectional shape of the partition in a plane view. In addition, intervals thereof and a shape and a structure of a fluid path between the mixing element portions 2 and 3 can control the operation.

Regarding the.opposite mixing element portion 2 for forming a fluid path, which is not mentioned in the above description, a conventional crash method with respect to a wall surface and a crash method by combining two fluid materials are utilized. In order to accomplish these operations effectively and control fluid speed and fluid amount, a shape and a structure of the mixing element portion may be modified instead of a simple cup shape. A crash wall may be formed together with the mixing element portion 3. A structure and a shape of the fluid path can be varied so as to widen or narrow a fluid path.

As described above, a shape and a structure of each component according to the present invention recited in claims can be varied corresponding to characteristics of a treated fluid material, a purpose and utility of a mixing operation. The shape and structure of the embodiment are not limited.

Applicability of the Invention in an Industry Field

A stationary mixing machine according to the present invention comprises groups of mixing chambers as fluid paths formed by mixing element portions. Its shape and structure and positioning relative to the confronted portions are simple or easy so that the shape and the structure of the portions can be easily modified corresponding to characteristics and utilities of fluid material and a particle diameter of required emulsion. Upon reviewing these stored data, a condition can become more properly.

A feature of the mixing machine according to the present invention is not to have any limitations concerning with a size of the portion in view of a function and a structure. By scaling up the production, the invention can be produced through an industrial process. On the other hand, the simple structure has merit for down sizing. In addition to the merit of the down sizing, baneful influence such as fluid emulsion, fluid resistance, viscosity resistance and turbulence can be avoided as less as possible. Even if a size of the machine is small or very small, an effect of the machine is as similar as that of a large sized machine.

In the mixing machine according to the present invention, a pressure loss is less so that a fluid amount is relatively large and the fluid material can be effectively flown. Further, a loading amount with respect to a pump can be reduced. By utilizing such an effect, a fine emulsion process can be operated by increasing a driving pressure that is belonged in an actual order range.

Regarding target mixed fluid materials, although a pair of two liquid materials is mainly explained, the similar effect can be accomplished with respect to a pair of air and liquid, a pair of liquid and solid and a pair of fluid materials having high viscosity. Thus, it is applicable to an aerosol nozzle with a small size or a micro size. Such an aerosol nozzle can be applicable to a mixing step, which has not been utilized since the pressure loss is small and the resistance is small. Further, the invention is excellent in view of a cleaning treatment in addition to the above-described simple structure so that the invention can be applied to a chemical industry and a food industry. Thus, the invention can be applied to various industries.

What is claimed is:

1. A mixing element body of a stationary type mixing machine comprising a double layered structure including a first mixing element portion and a second mixing element portion, wherein the mixing element body is characterized in that a first opening is provided at a board of one of the mixing element portions and groups of mixing chambers connected to said first opening are peripherally arranged adjacent one another at a boundary surface of the double layered structure, each group of the mixing chambers is concentrically arranged and a step for applying shearing stress is provided at a portion between a mixing chamber in one of said groups and a juxtaposed mixing chamber in an adjacent group so as to connect the mixing chamber in the one of the groups and the juxtaposed mixing chamber in the adjacent group to each other.

2. A mixing element body of a stationary type mixing machine, said mixing element body having a periphery and comprising a double layered structure including a first mixing element portion and a second mixing element portion, wherein a first opening is formed at a first board of said first mixing element portion, a circular first groove portion is formed in said first mixing element portion at a boundary surface of said double layered structure surrounding said first opening, a plurality of first section walls are radially arranged in said circular first groove portion so as to divide said circular first groove portion into at least one group of first mixing chambers, a circular second groove portion is formed in said second mixing element portion at a second board at a boundary surface of said double layered structure, a plurality of second section walls of which a number is equal to that of the first section walls are radially arranged in said second groove portion so as to divide said circular second groove portion into at least one group of second mixing chambers, one of said second mixing chambers and one of said first mixing chambers are partly overlapped along a radius direction, said first opening is connected to those of said said second mixing chambers that are most remote from the periphery of said mixing element body, and a second opening is connected to those of said first mixing chambers that are closest to the periphery of said mixing element body.

3. A mixing element body of the stationary mixing machine as claimed in claim 2, said mixing element body is characterized in that a plurality of groups of said first mixing chambers and a plurality of groups of said second mixing chambers are concentrically arranged.

4. A mixing element body of the stationary mixing machine as claimed in claim 2, wherein said mixing element body is characterized in that there is a plurality of groups of concentrically arranged first mixing chambers and a plurality of groups of concentrically arranged second mixing chambers, a position of said first section walls of said first mixing element portion and a position of said second section walls of said second mixing element portion are coincided along a peripheral direction.

5. A mixing element body of the stationary mixing machine as claimed in claim 2, wherein said mixing element body is characterized in that there is a plurality of groups of concentrically arranged first mixing chambers and a plurality of groups of concentrically arranged second mixing chambers, said first section walls are spaced from said second section walls along a peripheral direction of said mixing element body with a constant spacing between said first section walls and said second section walls.

6. A mixing element body of the stationary mixing machine as claimed in claim 2, wherein said mixing element body is characterized in that each mixing chamber is bounded by a respective circular groove portion.

7. A mixing element body of a stationary mixing machine comprising a double layered structure including a first mixing element body and a second mixing element body, a first opening is provided at said first mixing element body and a cup shaped casing is provided as a fluid path at said second mixing element body at a location confronting said first opening, a plurality of mixing chambers are peripherally arranged so as to connect to said first opening at a surrounding portion of a crash surface with respect to said first opening, groups of said mixing chambers peripherally arranged are concentrically arranged, and a step for applying shearing stress is provided at a portion between a mixing chamber in one group and a juxtaposed mixing chamber in another group adjacent the one group so as to connect the chambers to each other.

8. A mixing element body of a stationary mixing machine as claimed in claim 7, characterized in that each mixing chamber is divided with section walls and a step is formed at a portion between said groups of said mixing chambers in each adjacent rows along a radius direction, and a respective mixing chamber is formed by said section walls, said step and said cup shaped casing of the mixing element portion.

9. A mixing element body of a stationary mixing machine as claimed in claim 7, characterized in that said groups of mixing chambers are arranged in concentric rows, an inclined surface is provided between said mixing chambers in each of said rows, there are at least two of said steps provided at an outer periphery side of said inclined surface, and at least one of said mixing chambers in one of said rows is formed by two of said steps, an inclined surface formed between mixing chambers in the row adjacent said one of said rows and a cup shaped mixing element body.

10. A mixing body element as claimed in claim 7, characterized in that a portion between each adjacent respective chamber in one group is sectioned with an extended portion of a mixing chamber in an adjacent group, and a mixing chamber is formed by said step, said extended portion and a cup shaped mixing element body.

* * * * *